US008702187B2

(12) United States Patent
Ikeda et al.

(10) Patent No.: US 8,702,187 B2
(45) Date of Patent: Apr. 22, 2014

(54) DROPLET DISCHARGE DEVICE AND DROPLET DISCHARGE METHOD

(75) Inventors: Akira Ikeda, Nagano (JP); Masaru Ohnishi, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 232 days.

(21) Appl. No.: 13/391,821

(22) PCT Filed: Aug. 26, 2010

(86) PCT No.: PCT/JP2010/005278

§ 371 (c)(1),
(2), (4) Date: Feb. 23, 2012

(87) PCT Pub. No.: WO2011/024463

PCT Pub. Date: Mar. 3, 2011

(65) Prior Publication Data

US 2012/0147074 A1 Jun. 14, 2012

(30) Foreign Application Priority Data

Aug. 26, 2009 (JP) ..... PCT/JP2009/004122

(51) Int. Cl.
*B41J 25/308* (2006.01)
*B41J 29/38* (2006.01)

(52) U.S. Cl.
USPC ..... 347/8; 347/9

(58) Field of Classification Search
CPC ..... B41J 19/02; B41J 25/3082
USPC ..... 347/8, 9, 37, 101, 104
See application file for complete search history.

(56) References Cited

U.S. PATENT DOCUMENTS

| | | | | |
|---|---|---|---|---|
| 7,918,518 | B2 * | 4/2011 | Tanahashi et al. | 347/8 |
| 8,172,350 | B2 * | 5/2012 | Okuda et al. | 347/8 |
| 8,287,068 | B2 * | 10/2012 | Shimizu et al. | 347/9 |

FOREIGN PATENT DOCUMENTS

| | | |
|---|---|---|
| JP | 2005-045644 | 2/2005 |
| JP | 2005-283123 | 10/2005 |
| JP | 2007-203196 | 8/2007 |
| JP | 2009-179003 | 8/2009 |

* cited by examiner

*Primary Examiner* — An Do
(74) *Attorney, Agent, or Firm* — Jianq Chyun IP Office

(57) ABSTRACT

A printer comprises: a vacuum table for supporting a jig which holds a medium; a printer head for discharging droplets; and a relative movement means for moving the printer head relative to the medium; a registration mark detection unit and barcode detection unit for acquiring holding platform information and support position information for the jig; and a controller for controlling the movement of the printer head by the relative movement means and controlling the discharge of droplets from the printer head on the basis of the holding platform information, the support position information and information pertaining to the desired pattern. As a result of this configuration, it is possible to generate image data without aligning the jig with a reference position on the vacuum table.

20 Claims, 10 Drawing Sheets

DROPLET DISCHARGE DEVICE AND DROPLET DISCHARGE METHOD

CROSS-REFERENCE TO RELATED APPLICATION

This application is a 371 of international application of PCT application serial no. PCT/JP2010/005278, filed on Aug. 26, 2010, which claims the priority benefit of PCT application no. PCT/JP2009/004122, filed on Aug. 26, 2009. The entirety of each of the above-mentioned patent applications is hereby incorporated by reference herein and made a part of this specification.

TECHNICAL FIELD

The present invention relates to a droplet discharge device and a droplet discharge method by which droplets are caused to adhere to a medium by discharging the droplets from a droplet discharge unit.

BACKGROUND ART

As examples of such a droplet discharge device, devices that manufacture color filters for color liquid crystal panels, and inkjet printers (hereinafter, "printer"), etc., are known in the art. An inkjet printer performs printing on a medium, which is supported by a platen, by discharging an ink while causing a printer head, which is arranged facing the platen, to move horizontally. For example, a printer is disclosed in Patent Document 1 that performs printing on a medium, which is placed on a platen, by discharging an ink from a printer head that is caused to move along a guide rail.

As an example, printers are known that perform printing with ultraviolet curable ink (hereinafter, referred to as UV ink) that is cured when irradiated with an ultraviolet light. Because the UV ink has excellent weather resistance and water resistance properties, there is an advantage that a printed material can be used for an outdoor advertisement flyer, etc., so that the printed material printed with the UV ink can be used for various purposes as compared with the printed matter printed with a water-soluble ink. The water-soluble ink penetrates the medium, and is cured inside the medium, whereas, the UV ink does not penetrate the medium, and is cured on the surface of the medium. Therefore, there is an advantage that printing can be performed on a medium made of a material, such as, vinyl chloride material, that does not easily allow penetration of the ink. Consequently, printing performed using the UV ink is widespread in the industrial field.

Recently, there is a demand for performing printing not only on sheet-like mediums but also on surfaces of various mediums having a three-dimensional shape. When performing printing on such three-dimensional mediums, merely placing the medium on the platen is not adequate to give it positional stability so that the printer cannot accurately recognize the position of the medium on the platen. Therefore, in the conventional technology, a jig that holds the medium is mounted is prepared and an operator accurately aligns a position of the jig relative to, for example, a reference position of a bed in a flatbed printer. Thus, when the medium is placed on the jig, the medium can be stably held and the position of the medium relative to the bed can be accurately recognized.

CONVENTIONAL ART DOCUMENTS

Patent Documents

Patent Document 1: Japanese Patent Application Laid-open No. 2005-45644

DISCLOSURE OF INVENTION

Problem to be Solved by the Invention

When mounting the jig on the bed as described above, it is necessary for the operator to mount the jig carefully by aligning the position thereof with the reference position of the bed. For example, the operator first mounts the jig on the bed and then gradually shifts the position of the jig until the position of the jig ultimately matches with the reference position. Therefore, this mounting operation requires time and leads to degradation of work efficiency. Because the operator has to perform the mounting operation manually, and match the position of the jig with the reference position with higher precision to improve the printing quality, there is an increased workload on the operator. Furthermore, when printing is to be performed in one sitting on mediums having different sizes, shapes, etc., each requiring a separate jig, it is difficult to match the type of the jig and the position on the bed to enable the printer to recognize the position of the medium.

The present invention is made in view of the above problems and it is an object of the present invention to provide a droplet discharge device and a droplet discharge method that provide improved work efficiency, put less workload on the operator, and can perform printing on mediums having various shapes.

Means for Solving the Problems

To achieve the above advantages, a droplet discharge device according to an aspect of the present invention includes a base member (for example, a vacuum table 13 according to the embodiments) that supports a holding platform (for example, a jig according to the embodiments) that holds a medium at a predetermined medium holding position; a droplet discharge unit (for example, a printer head 32 according to the embodiments) that discharges droplets; a relative movement unit (for example, a left-right moving mechanism and a front-back moving mechanism according to the embodiments) that moves the droplet discharge unit relative to the medium, while the medium is held against the holding platform that is supported by the base member; a holding-platform information acquiring unit (for example, registration mark detection units 34, 134, barcode detection units 35, 335, RFID reader, IC chip reader, magnetic head, CCD camera according to the embodiments) that acquires holding platform information (for example, information stored in or attached to barcodes 61, 61*a*, 352, 356, RFID tag, IC chip, magnetic stripe, thermosensitive sheet according to the embodiments) for identifying the holding platform and support position information relating to a support position of the holding platform mounted on the base member; and a discharge control unit (for example, a controller 22 according to the embodiments) that controls movement of the droplet discharge unit by the relative movement unit and discharge of the droplets from the droplet discharge unit, based on information relating to the holding platform identified in the holding platform information acquired from the holding-platform information acquiring unit, the support position information acquired by the holding-platform information acquiring unit, and information relating to an intended pattern, to cause the droplets to adhere to a surface of the medium held at the predetermined medium holding position to form the intended pattern.

A droplet discharge device according to another aspect of the present invention includes a base member that supports a holding platform that holds a medium at a predetermined medium holding position; a droplet discharge unit that discharges droplets; a relative movement unit that moves the droplet discharge unit relative to the medium, while the medium is held against the holding platform that is supported by the base member; a holding-platform information acquiring unit (for example, registration mark detection units 34, 134, barcode detection units 35, 335, RFID reader, IC chip reader, magnetic head, CCD camera according to the embodiments) that acquires holding platform information (for example, information stored in or attached to barcodes 61, 61*a*, 352, 356, RFID tag, IC chip, magnetic stripe, thermosensitive sheet according to the embodiments) for identifying the holding platform; and a discharge control unit that controls movement of the droplet discharge unit by the relative movement unit and discharge of the droplets from the droplet discharge unit, based on information relating to the holding platform identified in the holding platform information acquired from the holding-platform information acquiring unit and information relating to an intended pattern, to cause the droplets to adhere to a surface of the medium held at the predetermined medium holding position to form the intended pattern.

A droplet discharge device according to still another aspect of the present invention includes a base member that supports a holding platform that holds a medium at a predetermined medium holding position; a droplet discharge unit that discharges droplets; a relative movement unit that moves the droplet discharge unit relative to the medium, while the medium is held against the holding platform that is supported by the base member; a holding-platform information acquiring unit (for example, registration mark detection units 34, 134 according to the embodiments) that acquires support position information relating to a support position of the holding platform mounted on the base member; and a discharge control unit that controls movement of the droplet discharge unit by the relative movement unit and discharge of the droplets from the droplet discharge unit, based on the support position information acquired by the holding-platform information acquiring unit and information relating to an intended pattern, to cause the droplets to adhere to a surface of the medium held at the predetermined medium holding position to form the intended pattern.

It is preferable to provide an information reading unit that reads the holding platform information of the holding platform.

It is preferable to provide an alignment holding unit (for example, a positioning member according to the embodiments) that aligns and holds the holding platform at a predetermined support position on the base member, and that the support position information is acquired based on the position of the holding platform that has been positioned and held by the alignment holding unit.

It is preferable to provide reference marks (for example, a first registration mark 62*a*, a second registration mark 62*b*, a third registration mark 62*c*, and a third registration mark 62*d* according to the embodiments) on the holding platform that are used for acquiring the support position information, and that the holding-platform information acquiring unit detects the reference marks to acquire the support position information.

It is preferable that the holding platform information includes at least one piece of information among information that identifies a type of the holding platform, position information that indicates a holding position of the medium in the holding platform, layout information of the medium, quantity information, dimension information, and shape information.

It is preferable that the holding platform is box-shaped with a hollow portion inside, the hollow portion is connected to a suction unit (for example, a supply/drain blower 14 according to the embodiments) that can produce a negative pressure in the hollow portion, a suction hole that communicates with the hollow portion is formed in a portion of the holding platform that is just off the medium holding position, and an airflow that flows toward the hollow portion is produced in the suction hole by the suction unit.

A droplet discharge method is performed by a droplet discharge device that includes a base member that supports a holding platform that holds a medium at a predetermined medium holding position, a droplet discharge unit that discharges droplets, and a relative movement unit that moves the droplet discharge unit relative to the medium, while the medium is held against the holding platform that is supported by the base member. The droplet discharge method includes acquiring holding platform information that identifies the holding platform and support position information relating to a support position of the holding platform mounted on the base member; and controlling movement of the droplet discharge unit by the relative movement unit and discharge of the droplets from the droplet discharge unit, based on information relating to the holding platform identified in the holding platform information acquired at the acquiring, the support position information acquired at the acquiring, and information relating to an intended pattern, and causing the droplets to adhere to a surface of the medium held at the predetermined medium holding position to form the intended pattern.

A droplet discharge method is performed by a droplet discharge device that includes a base member that supports a holding platform that holds a medium at a predetermined medium holding position, a droplet discharge unit that discharges droplets, and a relative movement unit that moves the droplet discharge unit relative to the medium, while the medium is held against the holding platform that is supported by the base member. The droplet discharge method includes acquiring holding platform information that identifies the holding platform; and controlling movement of ink discharge unit by the relative movement unit and discharge of the droplets from the droplet discharge unit, based on information relating to the holding platform identified in the holding platform information acquired at the acquiring and information relating to an intended pattern, and causing the droplets to adhere to a surface of the medium held at the predetermined medium holding position to form the intended pattern.

A droplet discharge method is performed by a droplet discharge device that includes a base member that supports a holding platform that holds a medium at a predetermined medium holding position, a droplet discharge unit that discharges droplets, and a relative movement unit that moves the droplet discharge unit relative to the medium, while the medium is held against the holding platform that is supported by the base member. The droplet discharge method includes acquiring support position information relating to a support position of the holding platform mounted on the base member; and controlling movement of the droplet discharge unit by the relative movement unit and discharge of the droplets from the droplet discharge unit, based on the support position information acquired at the acquiring and information relating to an intended pattern, and causing the droplets to adhere to a surface of the medium held at the predetermined medium holding position to form the intended pattern.

Advantages of the Invention

A droplet discharge device according to an aspect of the present invention includes a holding-platform information acquiring unit that acquires holding platform information and support position information of a holding platform. Control of movement of a droplet discharge unit and discharge of droplets from the droplet discharge unit are performed based on information acquired by the holding-platform information acquiring unit, to cause the droplets to adhere to a surface of a medium to form an intended pattern. Therefore, printing can be performed on the medium held against the holding platform by creating image data based on the holding platform information that includes, for example, position information indicating holding position, layout information of the medium, quantity information, dimension information, and shape information, and the support position information of the holding platform. An operator needs to spend less time during this operation compared with the conventional device in which when mounting the holding platform, the operator is required to align the holding platform with a reference position of a base member. Consequently, work efficiency is improved.

The droplet discharge device according to another aspect of the present invention includes the holding-platform information acquiring unit that acquires the holding platform information. The control of the movement of the droplet discharge unit and the discharge of the droplets from the droplet discharge unit are performed based on the holding platform information acquired by the holding-platform information acquiring unit, to cause the droplets to adhere to a surface of a medium to form an intended pattern. Consequently, printing can be performed on the medium held against the holding platform by creating the image data to be printed based on the holding platform information, that indicates, for example, what type of the medium is held against the holding platform, how many, and the layout of the medium.

The droplet discharge device according to still another aspect of the present invention includes the holding-platform information acquiring unit that acquires the support position information of the holding platform. The control of the movement of the droplet discharge unit and the discharge of the droplets from the droplet discharge unit are performed based on the support position information acquired by the holding-platform information acquiring unit, to cause the droplets to adhere to a surface of a medium to form an intended pattern. Consequently, printing can be performed on the medium held against the holding platform by creating the image data to be printed based on the support position information that indicates a position where the holding platform is mounted on the base member.

It is preferable that an information reading unit that reads the holding platform information of the holding platform be provided. By this, the holding platform information can be acquired from the holding platform accurately and without mistake.

Furthermore, it is preferable that an alignment holding unit that aligns and holds the holding platform against the base member at a predetermined support position be provided. By this, the support position information can be easily acquired because the position of the holding platform on the base member is already known.

It is preferable that reference marks for acquiring the support position information be provided on the holding platform and the support position information be acquired by detecting the reference marks. By this, the image data is corrected based on the positions of the reference marks and printing on the medium held against the holding platform can be performed regardless of the position where the holding platform is mounted on the base member or an orientation in which the holding platform is mounted.

It is preferable that the holding platform information include at least one piece of information among information identifying a type of the holding platform, the position information indicating a holding position of the medium on the holding platform, the layout information of the medium, the quantity information, the dimension information, and the shape information. If the holding platform information includes the information identifying the type of the holding platform, the type of each of the holding platforms can be accurately identified when printing is performed by mounting a plurality of types of the holding platforms on the base member at the same time. If the holding platform information includes the position information indicating the holding position of the medium, the position of the medium on which printing is to be performed can be detected accurately. If the holding platform information includes the layout information of the medium, the image data to be printed can be easily created by laying out the image data based on the layout information. If the holding platform information includes the quantity information, the image data to be printed can be easily created by reproducing the image data based on the quantity information. If the holding platform information includes the dimension information, a printing target area can be accurately detected based on dimensions of the medium. If the holding platform information includes the shape information, the printing target area (a shape of the printing target area) can be accurately detected based on a shape of the medium.

It is preferable that the droplet discharge device be configured to produce, by a suction unit, airflow in a suction hole that flows toward a hollow portion. With this structure, the droplets that are discharged from the droplet discharge unit and suspended near the holding platform in the form of a mist are sucked into the hollow portion through the suction hole, and therefore are prevented from adhering to the medium or the droplet discharge unit.

A droplet discharge method according to an aspect of the present invention includes a step of acquiring the holding platform information at which the holding platform information and the support position information of the holding platform are acquired, and a step of discharge control at which control of the movement of the droplet discharge unit and control of the discharge of the droplets from the droplet discharge unit are performed based on the information acquired at the step of acquiring, to cause the droplets to adhere to the surface of the medium to form an intended pattern. Consequently, printing can be performed on the medium held against the holding platform based on the holding platform information, that indicates, for example, what type of the medium is held against the holding platform, how many, and the layout of the medium, and the support position information of the holding platform.

The droplet discharge method according to another aspect of the present invention includes a step of acquiring the holding platform information at which the holding platform information is acquired, and a step of discharge control at which control of the movement of the droplet discharge unit and control of the discharge of the droplets from the droplet discharge unit are performed based on the information acquired at the step of acquiring, to cause the droplets to adhere to the surface of the medium to form an intended pattern. Consequently, printing can be performed on the medium held against the holding platform by creating the image data to be printed based on the holding platform information, that indicates, for example, what type of the medium is held against the holding platform, how many, and the layout of the medium.

The droplet discharge method according to still another aspect of the present invention includes a step of acquiring the holding platform information at which the support position information of the holding platform is acquired, and a step of discharge control at which control of the movement of the droplet discharge unit and control of the discharge of the droplets from the droplet discharge unit are performed based on the information acquired at the step of acquiring, to cause the droplets to adhere to the surface of the medium to form an intended pattern. Consequently, printing can be performed on the medium held against the holding platform by creating the image data to be printed based on the support position information that indicates the position where the holding platform is mounted on the base member.

BEST MODE(S) FOR CARRYING OUT THE INVENTION

Figure 1:
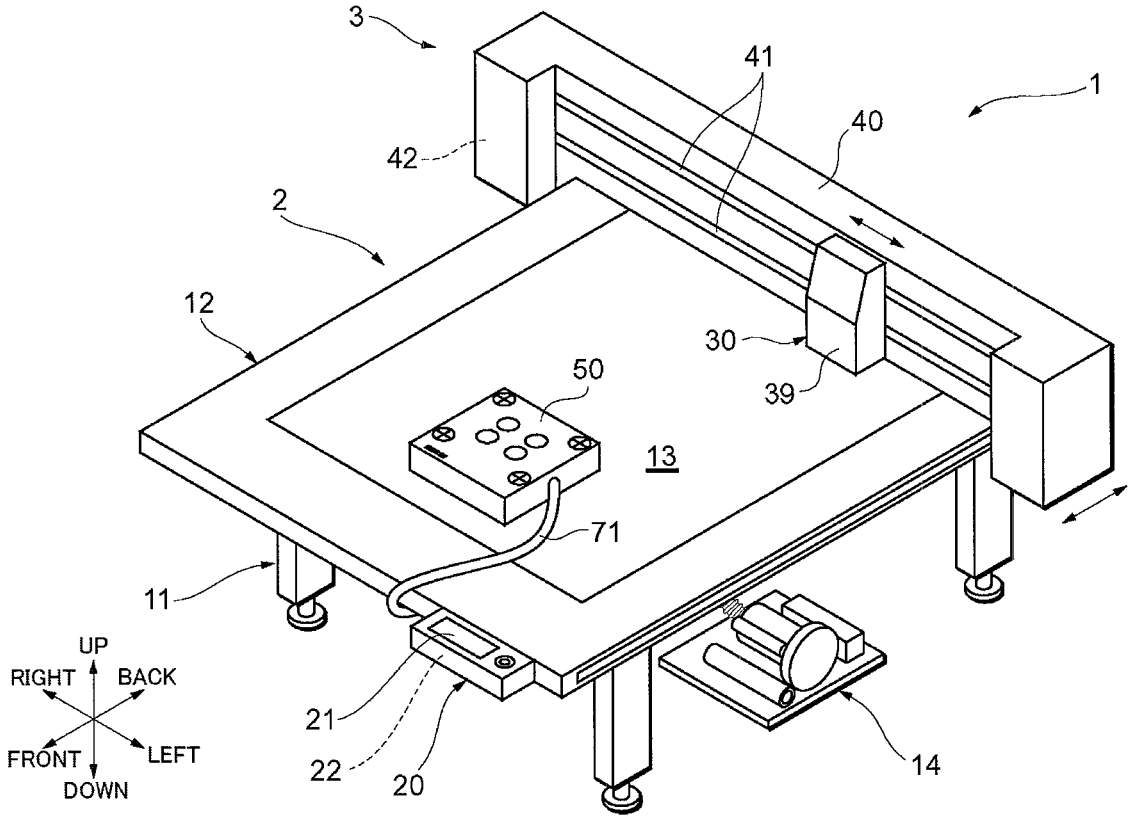
FIG. 1 is a perspective view of an outer appearance of a printer according to a first embodiment of the present invention.

Exemplary embodiments of the present invention are explained in detail below using first and second embodiments with reference to the accompanying drawings. For the sake of simplicity, an explanation will be given with the help of arrow directions that are shown in the drawings and defined as front-back, left-right, and up-down.

First Embodiment

Figure 2:
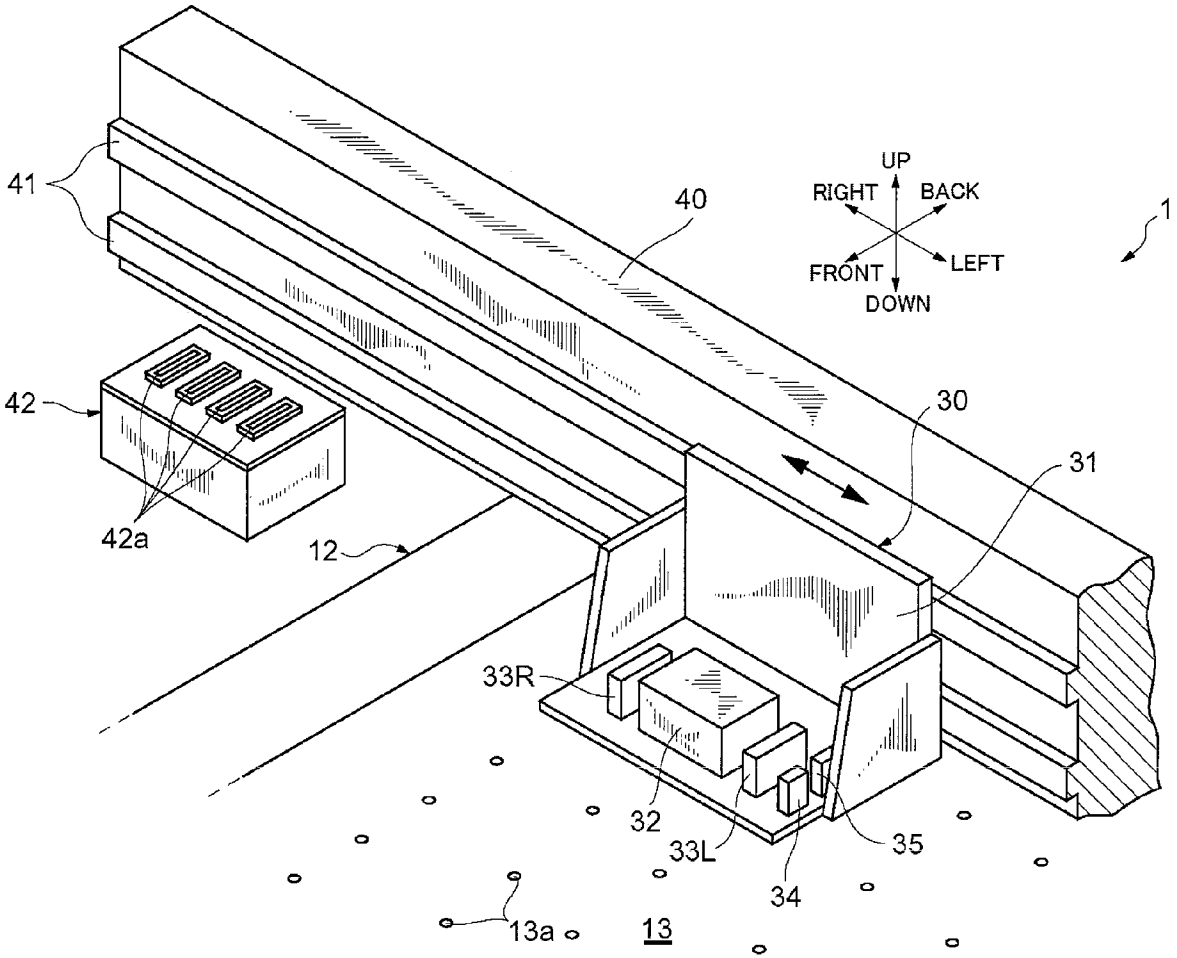
FIG. 2 is a perspective view near a guide rail in the printer shown in FIG. 1.
Figure 3:
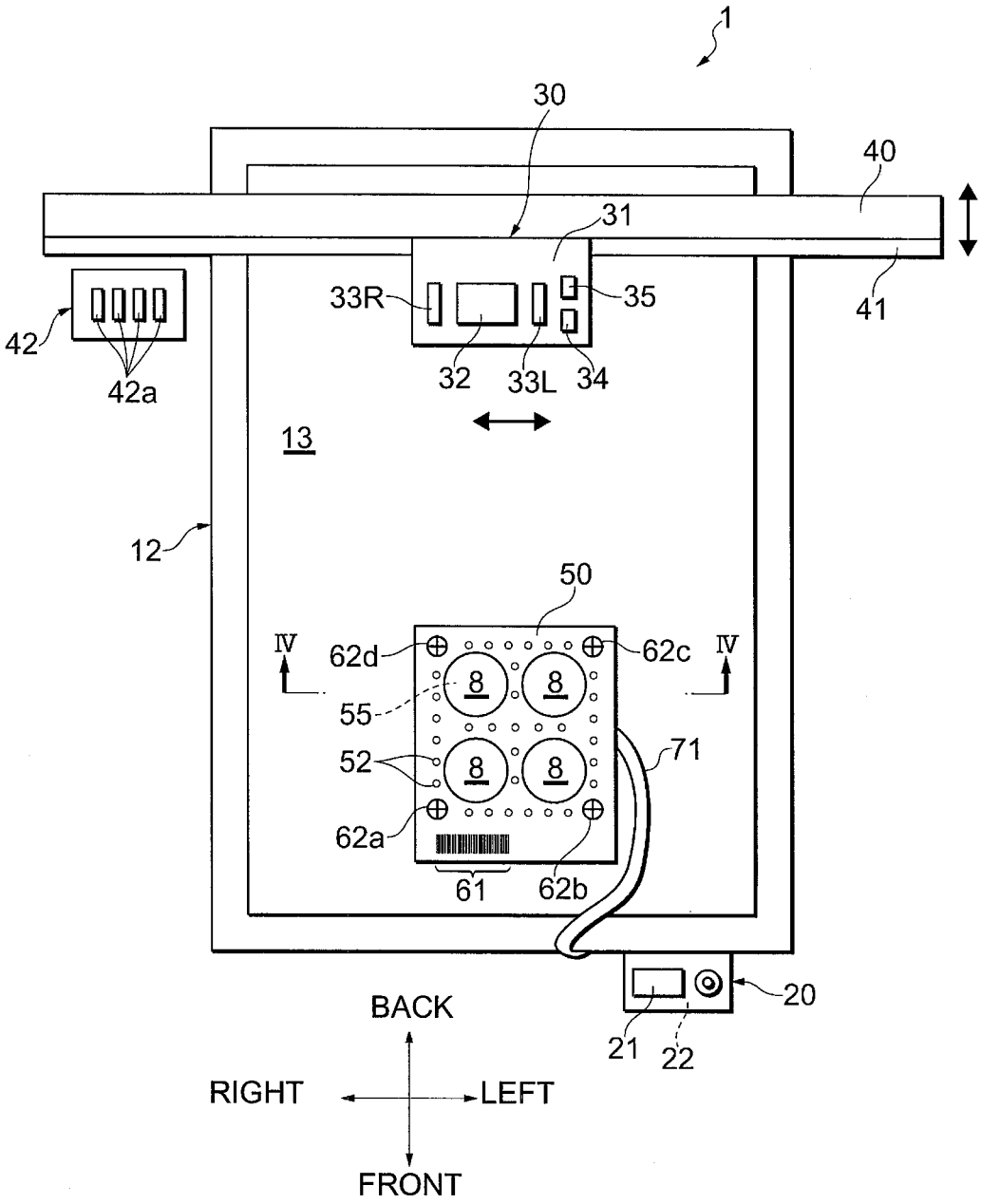
FIG. 3 is a plan view of the printer shown in FIG. 1.
Figure 4:
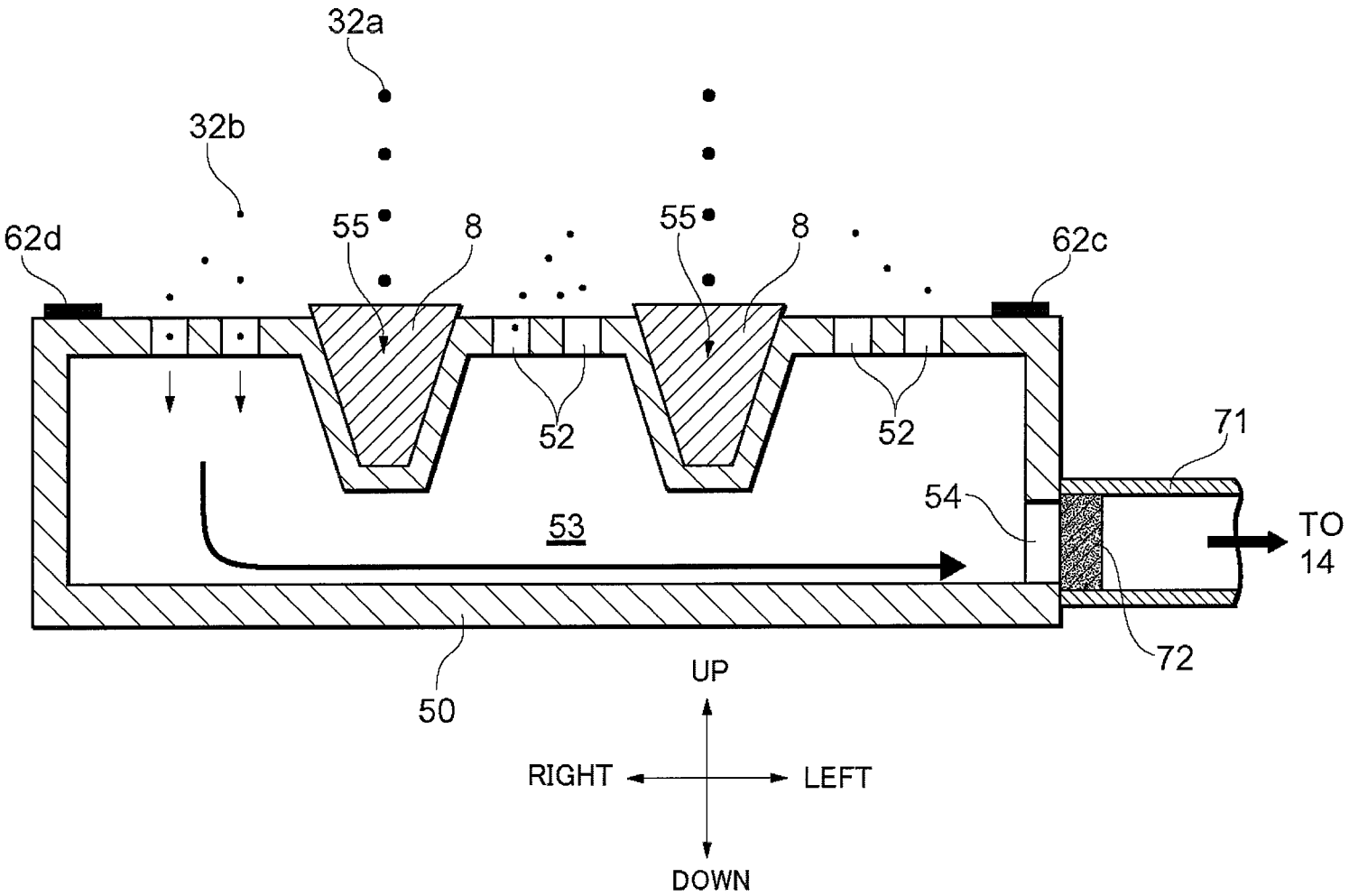
FIG. 4 is a cross-sectional view along a line IV-IV shown in FIG. 3.
Figure 5:
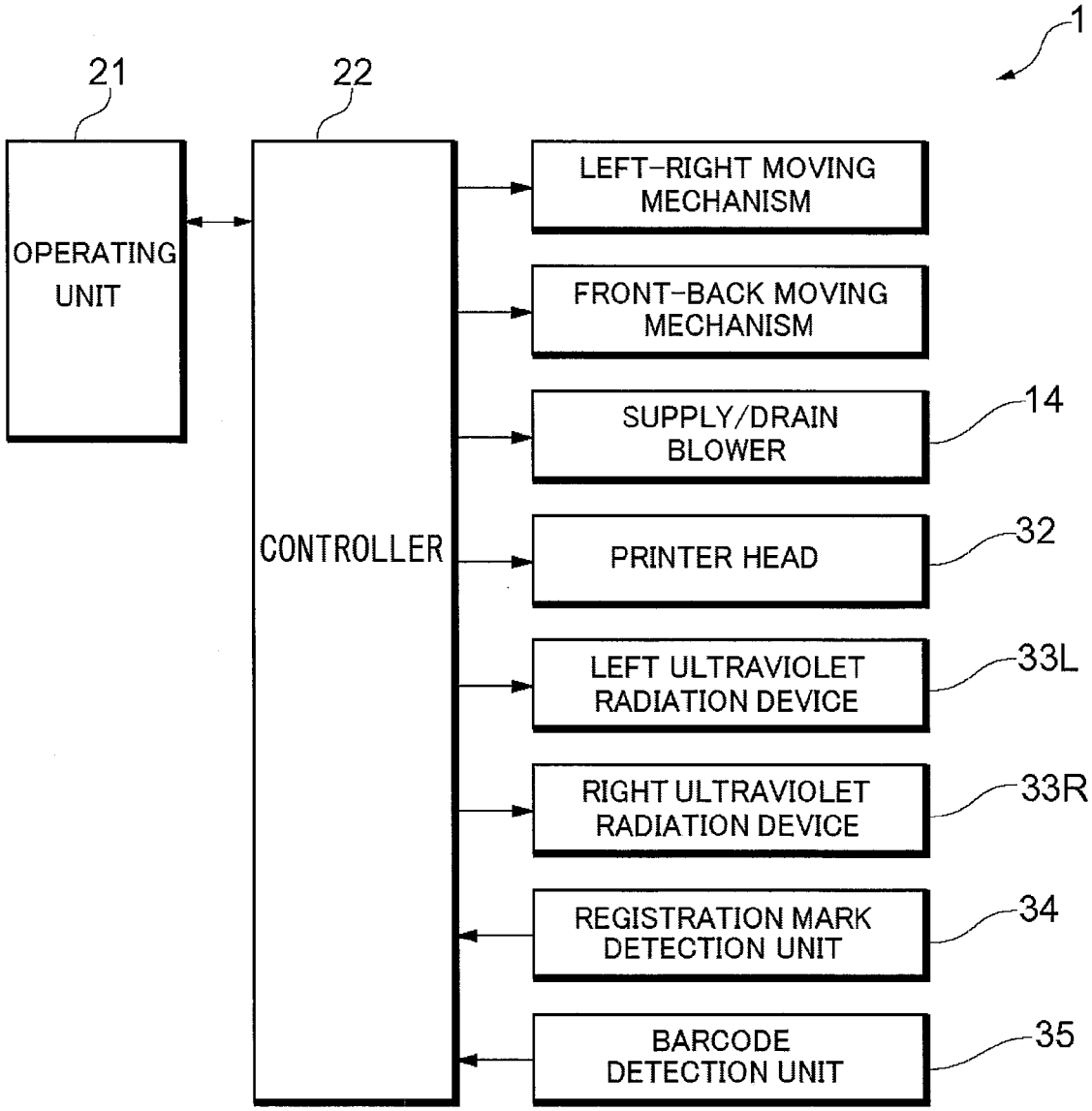
FIG. 5 is a drawing showing a control system of the printer shown in FIG. 1.

A structure of a printer 1 according to the first embodiment of the present invention is explained with reference to FIGS. 1 to 5. A structure when printing is performed on a bottom surface of a truncated cone-shaped medium 8 by adhering UV ink thereto is explained below as an example. FIG. 1 is a perspective view of the printer 1. FIG. 2 is a perspective view of a printing unit 30 that is described later. FIG. 3 is a plan view of the printer 1. FIG. 4 is a cross-sectional view of a jig 50 that is described later and FIG. 5 is a drawing showing a control system of the printer 1.

As shown in FIG. 1, the printer 1 includes a supporting section 2 that is arranged at the bottom and a printing section 3 that is movable in a front-back direction above the supporting section 2. The supporting section 2 includes supporting legs 11, a main table body 12 that is horizontally supported by the supporting legs 11, a supply/drain blower 14, and a control unit 20. A rectangular vacuum table 13 is arranged in the central portion of the main table body 12. A not shown decompression chamber is arranged on the downside (backside) of the vacuum table 13. The surface of the vacuum table 13 communicates with the decompression chamber by a plurality of supply/drain holes 13*a* that runs through vertically (see FIG. 2).

The supply/drain blower 14 is connected to the decompression chamber and a drain tube 71, which is described later, and sucks in air and feeds air. By sucking the air from the decompression chamber through the supply/drain holes 13*a*, the supply/drain blower 14 causes a medium, etc., placed on the surface of the vacuum table 13 to be stuck to the vacuum table 13 by suction.

The control unit 20 is arranged on the front edge of the main table body 12. The control unit 20 includes an operating unit 21 that in turn includes operation switches, display devices, etc., and a built-in controller 22. The controller 22 performs operation control. That is, the controller 22 is electrically connected to the operating unit 21 and receives operation signals from the operating unit 21, and the controller 22 is electrically connected to various constituent parts, which are described later, and outputs the received operation signals to the various constituent parts.

Specifically, as shown in FIG. 5, the controller 22 controls driving of a left-right moving mechanism, a front-back moving mechanism, and the supply/drain blower 14, discharge of the UV ink from a printer head 32, and irradiation of ultraviolet light from a left ultraviolet radiation device 33L and a right ultraviolet radiation device 33R, all of which are described in detail later. A received light result output by a registration mark detection unit 34, which is described later, in response to an inspection light, and information read by a barcode detection unit 35 are supplied to the controller 22.

The printing section 3 includes a guide member 40 that extends in a left-right direction above the main table body 12, a built-in maintenance device 42 arranged on a right end of the guide member 40, and the printing unit 30 that is attached to guide rails 41 that extend in the left-right direction on the front surface of the guide member 40.

As shown in FIG. 1, an outer periphery of the printing unit 30 is covered by a cover 39. In FIG. 2, the printing unit 30 is shown with the cover 39 removed. As shown in FIG. 2, the printing unit 30 includes a single carriage 31, the printer head 32, the right ultraviolet radiation device 33R and the left ultraviolet radiation device 33L that are, respectively, arranged on the right and left sides of the printer head 32, the registration mark detection unit 34, and the barcode detection unit 35.

The single carriage 31 is coupled to the guide rails 41 so as to be movable in the left-right direction. The single carriage 31 serves as a mounting base for the printer head 32, the right ultraviolet radiation device 33R, the left ultraviolet radiation device 33L, the registration mark detection unit 34, and the barcode detection unit 35. One printer head 32 is arranged for ink of each color, for example, magenta, yellow, cyan, and black, and each printer head 32 includes a plurality of not shown discharge nozzles formed on a bottom surface thereof to discharge the UV ink downward. Each of the right ultraviolet radiation device 33R and the left ultraviolet radiation device 33L includes a not shown built-in UVLED capable of emitting the ultraviolet light downward.

The registration mark detection unit 34 includes on a bottom surface thereof a not shown light emitting unit and a not shown light receiving unit. The light receiving unit receives a reflected light of the inspection light that is emitted downward from the light emitting unit. When the registration mark detection unit 34 is moved over the jig 50 that is described later, the inspection light (a high-intensity inspection light) is reflected back from the portions where a first registration mark 62*a* to a fourth registration mark 62*d* are not formed, and the reflected light is received by the light receiving unit. On the other hand, no inspection light is emitted (or a low-intensity inspection light is emitted) by the light emitting unit over the portions where the first registration mark 62*a* to the fourth registration mark 62*d* are formed. Therefore, whether the first registration mark 62*a* to the fourth registration mark 62*d* are located below the registration mark detection unit 34 can be detected based on the received light result output by the light receiving unit.

A not shown reading unit is formed on the bottom surface of the barcode detection unit 35. When the barcode detection unit 35 is moved over a barcode 61 that is described later, the reading unit reads information encoded in the barcode 61. Four cap members 42*a* having a shape similar to that of the bottom surface of the printer heads 32 (the surfaces on which the discharge nozzles are formed) are arranged at prescribed positions on the upper surface of the maintenance device 42. With this structure, by moving the printing unit 30 to the right so that the printer heads 32 and the cap members 42*a* are vertically aligned and moving the cap members 42 upward, the bottom surface of the printer heads 32 can be covered with the cap members 42*a*. By doing so, the UV ink in the discharge nozzles can be prevented from drying (thickening) Reading of the barcode 61 by the barcode detection unit 35, for example, is similar to the operations performed by the registration mark detection unit 34.

The printing unit 30 is moved in the left-right direction along the guide rails 41 by a not shown left-right moving mechanism. The guide member 40 is slid, with the printing unit 30 and the maintenance device 42 mounted thereon as described above, in a front-back direction by a not shown front-back moving mechanism. Various known technologies can be used as the left-right moving mechanism and the front-back moving mechanism, and hence, the explanation thereof is omitted in the present specification.

When printing on, for example, a flat plate-like medium, the medium can be directly placed on the vacuum table 13. However, when performing printing on the bottom surface of the truncated cone-shaped medium 8, directly placing the medium on the vacuum table 13 makes its posture unstable, and the printer 1 cannot accurately recognize the position of the medium on the vacuum table 13. Therefore, by mounting the jig 50 according to the present embodiment on the vacuum table 13 and placing the medium 8 on the jig 50, the medium 8 can be stably held and the position accuracy can be ensured. A structure of the jig 50 is explained below with reference to FIGS. 3 and 4.

The jig 50 mounted on the vacuum table 13 is fixed to the vacuum table 13 by the action of the supply/drain blower 14. As shown in FIG. 4, the jig 50 is a box-like rectangular parallelepiped with a hollow portion 53 formed therein. Four containing recesses 55 that stably hold the medium 8 are formed on the upper portion of the jig 50, and a plurality of suction holes 52 communicating with the hollow portion 53 is formed around the containing recesses 55. A drain hole 54 communicating with the hollow portion 53 is formed on the left portion of the jig 50, and the drain tube 71 is connected thereto. A filter 72 that allows the air to pass and collects the ink that is suspended in the form of a mist is arranged on an edge of the drain tube 71 on the drain hole 54 side.

As shown in FIG. 3, the first registration mark 62*a*, the second registration mark 62*b*, the third registration mark 62*c*, and the fourth registration mark 62*d* are formed near four corners on the upper surface of the jig 50. The first registration mark 62*a*, the second registration mark 62*b*, the third registration mark 62*c*, and the fourth registration mark 62*d* are prepared as reference marks using a combination of a cross and a circle so as to surround the containing recesses 55, and at predetermined positions relative to the containing recesses 55. The barcode 61 is formed on, for example, the front edge on an upper surface of the jig 50 as an identifier that represents information relating to the jig 50.

The barcode 61 contains information, such as, outer dimensions of the jig 50, sizes and number of the containing recesses 55, number of the registration marks (the first registration mark 62*a* to the fourth registration mark 62*d*), a positional relation between two registration marks, positional relations of the containing recesses 55 relative to the registration marks, a registration mark (for example, the first registration mark 62*a*) that represents a reference mark among the plurality of the registration marks, and positional relations of the registration marks with respect to the reference mark to the barcode 61. As long as the information encoded in the barcode 61 can be read by the barcode detection unit 35, the barcode 61 can be formed on a side surface, etc., of the jig 50. Coordinates when a certain registration mark (for example, the first registration mark 62*a*) is set as the reference mark are set such that a direction defined by the first registration mark 62*a* and the second registration mark 62*b* is set as a first axis and a direction defined by the first registration mark 62*a* and the fourth registration mark 62*d* is set as a second axis.

The structure of the printer 1 is explained so far. Operations of the printer 1 when performing printing on the bottom surface of the truncated cone-shaped medium 8 by causing the UV ink to adhere thereto are explained with reference to a flowchart explained in FIG. 6.

Figure 6:
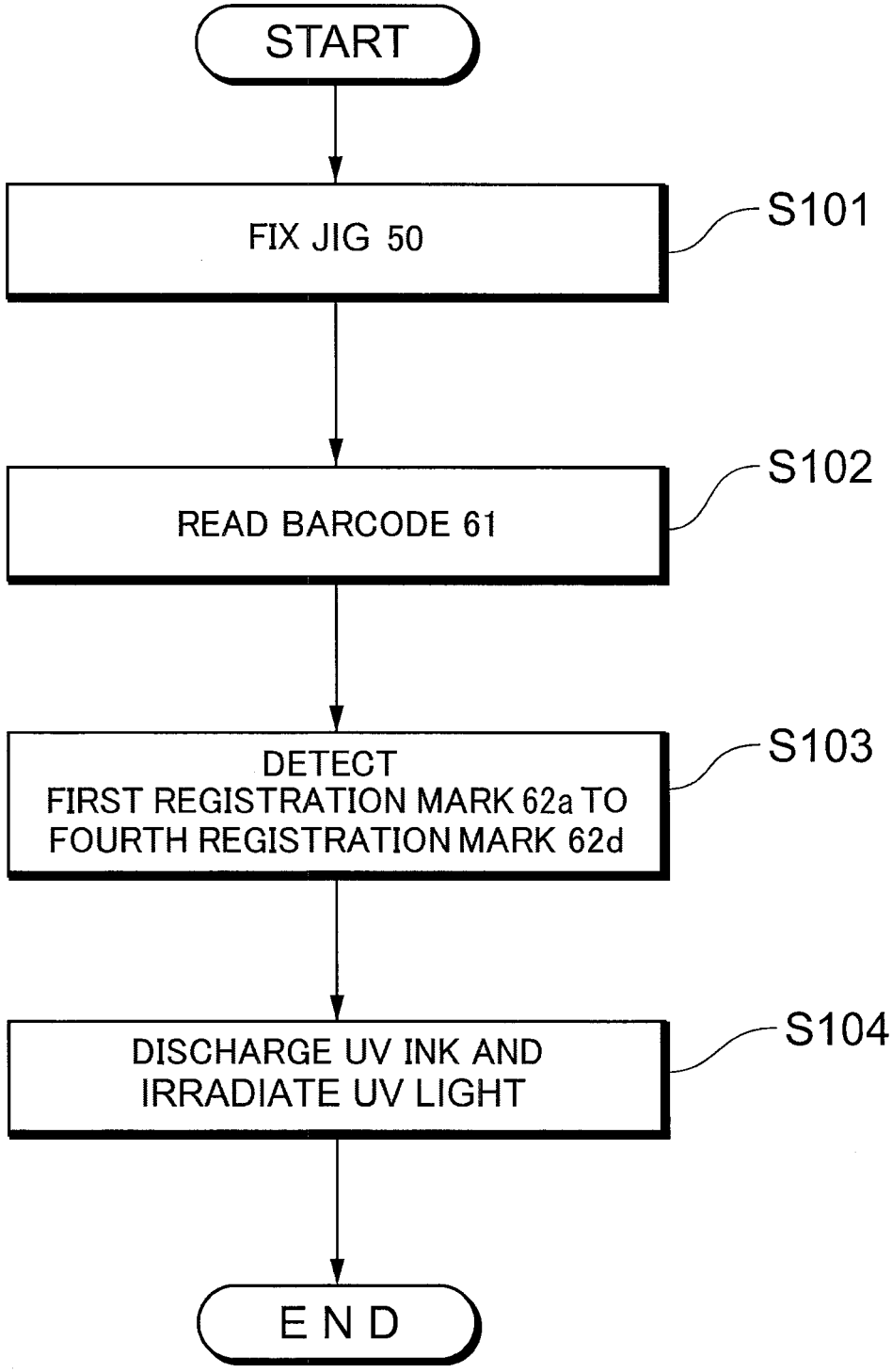
FIG. 6 is a flowchart of operations performed when performing printing using the printer shown in FIG. 1.

At Step S101 of FIG. 6, the jig 50 is mounted on and fixed to the vacuum table 13. As described later, in the printer 1, the position of the medium 8 relative to the vacuum table 13 can be accurately detected irrespective of a mounting position and an orientation of the jig 50 relative to the vacuum table 13. Thus, the operator can mount the jig 50 on the vacuum table 13 without being particularly careful about the mounting position and the orientation of the jig 50. In FIG. 3, a case is explained as an example in which the jig 50 is mounted on the rectangular vacuum table 13 so as to be parallel in the left-right and front-back directions. However, the jig 50 need not necessarily be mounted in this manner. After the jig 50 is mounted on and fixed to the vacuum table 13, the medium 8 is placed inside each of the containing recesses 55 with the bottom surface of the medium 8 facing upward.

It is preferable that the jig 50 be mounted such that it is substantially parallel in the left-right and front-back directions to the rectangular vacuum table 13. When the jig 50 is mounted in this manner, as described later, the movement of the printing unit 30 performed by the left-right moving mechanism and the movement of the guide member 40 performed by the front-back moving mechanism can be reduced when detecting the first registration mark 62*a* to the fourth registration mark 62*b*. Consequently, the work efficiency can be improved by shortening the time required for printing.

At the next Step S102, the operator switches on, for example, a not shown "detect position" button on the operating unit 21 to output the operation signals from the controller 22 to the left-right driving mechanism and the front-back driving mechanism. Thereafter, the barcode detection unit 35 is moved in the left-right and/or front-back directions. As a result of this movement, when the barcode detection unit 35 comes above the barcode 61, the barcode detection unit 35 reads the information relating to the jig 50 that is encoded in the barcode 61, and outputs the information to the controller 22.

At Step S102, the operator can position the barcode detection unit 35 above the barcode 61 by manually operating the left-right driving mechanism and the front-back driving mechanism. It is preferable that a vertical position of the printing section 3 relative to the supporting section 2 be adjusted automatically according to a vertical height of the jig 50 obtained from the information detected by the barcode detection unit 35 as described above. With this structure, printing can be performed using the jig 50 having different vertical heights.

At the next Step S103, the controller 22 refers to the positional relation of the first registration mark 62*a* (reference mark) relative to the barcode 61 from the information obtained at Step S102. Thereafter, the controller 22 outputs the operation signals to the left-right driving mechanism and the front-back driving mechanism so as to position the registration mark detection unit 34 above and near the first registration mark 62*a*. When the registration mark detection unit 34 is placed above and near the first registration mark 62*a*, the controller 22 detects a received light status of the inspection light received by the receiving unit of the registration mark detection unit 34 while slightly moving the registration mark detection unit 34 in the left-right and/or front-back directions to detect the position of the first registration mark 62*a* relative to the vacuum table 13.

Once the position of the first registration mark 62*a* is detected, the controller 22 refers to the positional relation of the second registration mark 62*b* relative to the first registration mark 62*a* and positions the registration mark detection unit 34 above and near the second registration mark 62*b*. Subsequently, the controller 22 detects the position of the second registration mark 62*b* relative to the vacuum table 13 in a similar manner as for the first registration mark 62*a*. Similarly, the controller 22 detects the positions of the third registration mark 62*c* and the fourth registration mark 62*d* relative to the vacuum table 13 after the position of the second registration mark 62*b* is detected.

Thereafter, the controller 22 refers to the positions of the first registration mark 62*a* to the fourth registration mark 62*d* relative to the vacuum table 13 detected as described above, and the positional relation of each of the containing recesses 55 relative to the first registration mark 62*a* to the fourth registration mark 62*d* output from the barcode detection unit 35. In this case, the position of each containing recess 55 (the medium 8) relative to the vacuum table 13 can be calculated by matching each position of the first registration mark 62 output by the barcode detection unit 35 with each position of the first registration mark 62*a* to the fourth registration mark 62*d* relative to the vacuum table detected as described above. Thus, what kind of control is to be exerted over the discharge of the UV ink and the irradiation with the ultraviolet light when the printing unit 30 is moved to a specific position over the vacuum table 13 (a position in the left-right and front-back directions) to perform the desired printing on the bottom surface of the medium 8 is recognized by the controller 22.

Due to this, hypothetically, even if the jig 50 is somewhat tilted relative to the vacuum table 13, by reading the information encoded in the barcode 61 and detecting the positions of the first registration mark 62*a* to the fourth registration mark 62*d*, the position of the medium 8 relative to the vacuum table 13 can be detected more precisely. Therefore, positioning of the jig 50 with respect to the vacuum table 13 as is required in the conventional technology is not required. Consequently, the workload on the operator can be reduced and the work efficiency can be improved by shortening the operation time.

At the next Step S104, the controller 22 moves the printing unit 30 in the left-right and front-back directions such that the printer heads 32 face the containing recesses 55 (the bottom surface of the medium 8) based on the position of each of the containing recesses 55 calculated as described above. Printing can be performed on the bottom surface of the medium 8 by exerting a combination of control over moving the printing unit 30 from left to right and/or front to back, discharging the UV ink from the printer head 32, and irradiating the ultraviolet light from the right ultraviolet radiation device 33R and the left ultraviolet radiation device 33L.

When printing is performed at Step S104, as shown in FIG. 4, from the UV ink discharged from the printer head 32 towards the medium 8, ink droplets 32*a* having a relatively large diameter adhere to a target position on the medium 8. On the other hand, ink droplets 32*b* having a relatively small diameter form a mist do not reach the medium 8 to remain suspended between the printer head 32 and the medium 8. The suspended ink droplets 32*b* adhere to the discharge nozzles of the printer head 32 leading to failure in discharge of the ink. Alternatively, the ink droplets 32*b* adhere to positions other than the target positions on the medium 8 leading to degradation of the printing quality. Specifically, these problems are more pronounced when a distance set between the printer head 32 and the medium 8 is large.

To solve the above problems, the printer 1 according to the present embodiment is configured such that a plurality of the suction holes 52 is formed on the upper portion of the jig 50 and the supply/drain blower 14 sucks the air in the hollow portion 53. With this structure, airflow towards the hollow portion 53 is generated in the suction holes 52 by producing a negative pressure in the hollow portion 53. Due to this airflow, the ink droplets 32*b* suspended between the printer head 32 and the medium 8 are sucked into the suction holes 52, guided to the hollow portion 53, and thereafter, collected by the filter 72. By forcibly sucking the suspended ink droplets 32*b* in this manner, failure in discharge of the ink and degradation of the printing quality can be prevented.

One of the advantages achieved by the structure described in the first embodiment above is that the position of the medium 8 relative to the vacuum table 13 can be detected by reading the information encoded in the barcode 61 formed on the jig 50 and detecting the first registration mark 62*a* to the fourth registration mark 62*d* even if the jig 50 is mounted on an arbitrary position on the vacuum table 13. Therefore, printing can be performed even on a three-dimensional medium 8, which cannot be directly placed on the vacuum table 13, using the jig 50.

Second Embodiment

A structure of a printer 1' according to the second embodiment of the present invention is explained with reference to FIG. 7. The same reference numerals are assigned to the components that are identical to that of the printer 1 according to the first embodiment and explanation thereof is omitted. Components having a structure different from that of the first embodiment are explained below.

In the printer 1', a work unit 30*a* and a detection unit 30*b* are attached to the guide rails 41 that are formed on the front surface of the guide member 40 so as to be movable in the left-right direction. In the work unit 30*a*, the printer head 32, the right ultraviolet radiation device 33R and the left ultraviolet radiation device 33L are mounted on a work carriage 31*a*. In the detection unit 30*b*, the registration mark detection unit 34 and the barcode detection unit 35 are mounted on a detection carriage 31*b*.

Figure 7:
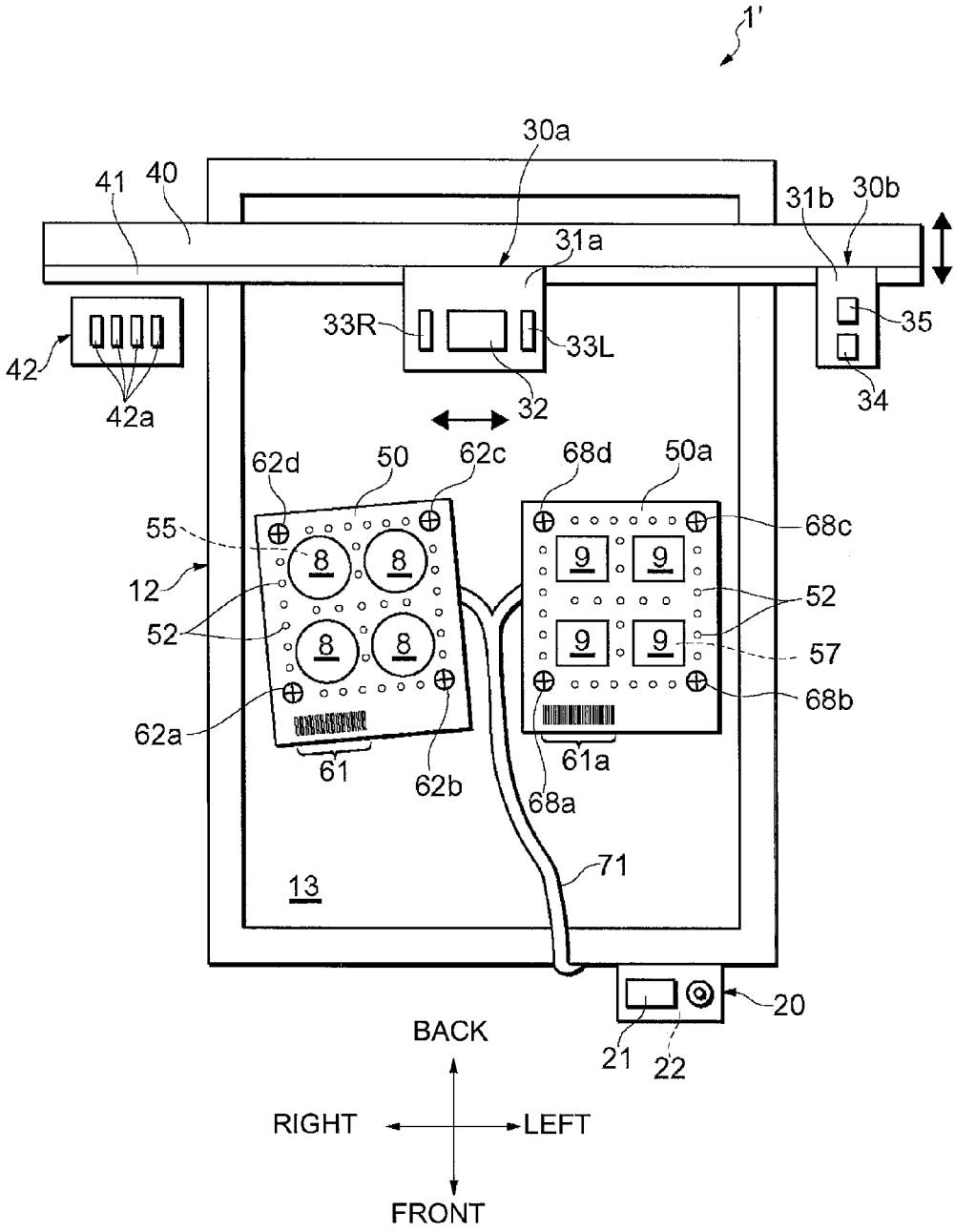
FIG. 7 is a plan view of a printer according to a second embodiment of the present invention.

In FIG. 7, a case is explained as an example in which the jig 50 and a jig 50*a* having a structure partially different from the jig 50 are mounted on and fixed to the vacuum table 13. Four containing recesses 57 that can hold, for example, a truncated pyramid-shaped medium 9 with the bottom surface thereof facing upward are formed on the central portion of the jig 50*a*. Similar to the barcode 61, a barcode 61*a* contains a positional relation, etc., of each of the containing recesses 57 relative to a first registration mark 68*a* to a fourth registration mark 68*d*.

How printing is performed on the bottom surfaces of the mediums 8 and 9 using the printer 1' configured as described above is explained below. A case is explained below as an example in which printing is performed on the bottom surface of the medium 9 after performing printing on the bottom surface of the medium 8.

In a standby mode of the printer 1' before starting the printing, the work unit 30*a* is moved to the right to cover the bottom surfaces of the printer heads 32 by the cap members 42 and the detection unit 30*b* is moved to the left and placed on the left end of the guide rails 41. When printing is started in such a state, the detection unit 30*b* is moved in the left-right and/or front-back directions and the information encoded in the barcode 61 is read by the barcode detection unit 35.

The registration mark detection unit 34 detects the positions of the first registration mark 62*a* to the fourth registration mark 62*d*. After completion of detection, the detection unit 30*b* is moved to the left, and placed on the left end of the guide rails 41 as in the standby mode. Similar to the first embodiment, the controller 22 calculates the position of the medium 8 relative to the vacuum table 13 and printing is performed on the bottom surface of the medium 8 based on calculation results.

After completion of printing on the bottom surface of the medium 8, similarly as described above, reading of the information encoded in the barcode 61, detection of the first registration mark 68*a* to the fourth registration mark 68*d*, and calculation of the position of the medium 9 relative to the vacuum table 13 are sequentially performed, and thereafter, printing is performed on the bottom surface of the medium 9.

In the printer 1', the work unit 30*a* and the detection unit 30*b* are configured separately. When performing printing by discharging the UV ink from the printer head 32, the detection unit 30*b* is moved to the left end of the guide rails 41. Therefore, lowering of light reception sensitivity of the inspection light by the registration mark detection unit 34 and lowering of reading sensitivity by the barcode detection unit 35 due to the ink droplets 32*b* adhering to the registration mark detection unit 34 and the barcode detection unit 35 in the form of a mist can be prevented.

Even if a plurality of jigs of different types (for example, the jig 50 and the jig 50*a*) is mounted on the vacuum table 13, the information relating to each of the jigs 50 and 50*a* is read from the barcodes 61 and 61*a*, respectively, and as a result, the positions of each of the mediums 8 and 9 relative to the vacuum table 13 can be accurately detected. Therefore, for example, printing can be performed simultaneously by mounting four jigs of different types on the vacuum table 13. Thus, a considerable amount of time required for mounting the jig 50 on the vacuum table 13 and removing it from the vacuum table 13 can be saved, and the work efficiency can be improved by shortening the operation time.

One of the advantages achieved by the structure described in the second embodiment above is that, the position of each medium relative to the vacuum table 13 can be automatically detected even if a plurality of types of the jigs holding mediums of different shapes is mounted at arbitrary positions on the vacuum table 13, and as a result, printing can be performed on the mediums having different shapes.

In the second embodiment, a case is explained as an example in which printing is performed on the bottom surface of the medium 9 after completing printing on the bottom surface of the medium 8. However, printing can be performed on the bottom surfaces of the mediums 8 and 9 simultaneously. For example, the barcodes 61 and 61*a* are read successively, and the first registration mark 62*a* to the fourth registration mark 62*d* and the first registration mark 68*a* to the fourth registration mark 68*d* are detected successively. Thus, the positions of the mediums 8 and 9 relative to the vacuum table 13 are calculated and printing is performed on the bottom surfaces of the mediums 8 and 9 based on the calculation results.

In the second embodiment, a structure is explained as an example in which printing is performed on the bottom surfaces of the truncated cone-shaped medium 8 and the truncated pyramid-shaped medium 9. However, printing can be performed on mediums having shapes other than the shapes described above by applying the present invention. For example, printing can be performed on various mediums having three-dimensional shapes by preparing a jig on which containing recesses that can hold a medium with a printing surface thereof facing upward are formed.

In the first and second embodiments, a structure is explained as an example in which the supply/drain blower 14 is used to suck in and collect the ink 32*b* that is suspended in the form of a mist on the jig. However, the present invention is not limited to this structure. For example, a jig with a built-in drain pump can also be used. In this structure, because there is no need to use the drain tube 71, the structure of the printer can be simplified.

In the first and second embodiments, the right ultraviolet radiation device 33R and the left ultraviolet radiation device 33L on which the UVLED is mounted as a light source for irradiating the ultraviolet light are explained as an example. However, other than the UVLED, a metal halide lamp that can irradiate the ultraviolet light, a visible light LED, a high-pressure mercury lamp, a sterilizing lamp, a black lamp that can efficiently irradiate the ultraviolet light by removing a visible light, a UV-B lamp that can irradiate the ultraviolet light having a wavelength range of approximately 280 nanometers (nm) to 315 nm, a UV-C lamp that can irradiate the ultraviolet light having a wavelength range less than or equal to approximately 280 nm, an electron irradiation device, etc., can also be used as the light source. Furthermore, a physical property value (for example, strength, curing timing, etc.) of the UV ink to be used can be linked to the information encoded in the barcode.

In the first and second embodiments, the jig 50 (50*a*) with four registration marks, namely, the first registration mark 62*a* to the fourth registration mark 62*d* (the first registration mark 68*a* to the fourth registration mark 68*d*) formed thereon is explained as an example. However, the present invention is not limited to this structure. Positions of the registration marks and the containing recesses can be associated in the left-right and front-back directions in a plane. Therefore, at least three registration marks can be formed on the jig 50 (50*a*) at different positions.

In the first and second embodiments, a structure is explained in which four registration marks, namely, the first registration mark 62*a* to the fourth registration mark 62*d* (the first registration mark 68*a* to the fourth registration mark 68*d*) are formed as a combination of a cross and a circle. However, the shape of the registration marks is not limited to the shape described above. As long as the registration mark detection unit 34 can detect the registration marks, the registration marks can be formed in, for example, an L shape, a circular shape, or a triangular shape. Alternatively, the registration marks can be formed in a combination of shapes described above.

In the first and second embodiments, a structure of the printer 1 to which the present invention is applied is explained as an example in which the carriage is moved in the front-back and/or left-right directions relative to the vacuum table 13. However, the present invention is not limited to this structure. The present invention can be applied to a flatbed printer in which the vacuum table 13 is moved in the front-back and/or left-right directions relative to a fixed carriage.

In the first and second embodiments, a structure is explained as an example in which the barcode detection unit 35 is mounted on the single carriage 31 (the work carriage 31*a*). However, the present invention is not limited to this structure. For example, the operator can manually hold the barcode detection unit 35 over the barcode 61 (the barcode 61*a*) and read the information.

In the first and second embodiments, a structure is explained as an example in which various information relating to the jig 50 (50*a*) is encoded in the barcode 61 (a one-dimensional code). However, the present invention is not limited to this structure. For example, a two-dimensional code that holds information in a horizontal direction and a vertical direction can also be used. Alternatively, an RFID (Radio Frequency Identification) tag that stores therein the information relating to the jig 50 (50*a*) can be attached to the jig 50 (50*a*). A not shown reader can read the information transmitted from the RFID tag and the read information can be output to the controller 22. Other than the RFID tag, a compact semiconductor integrated circuit (IC) chip that stores therein the information described above can be attached to the jig 50 (50*a*).

In the first and second embodiments, a structure is explained as an example in which the barcode detection unit 35 reads the information encoded in the barcode 61 and obtains the information relating to the jig 50 (50*a*). However, the present invention is not limited to this structure. Instead of using the barcode detection unit 35, a structure can be used in which the information encoded in the barcode 61 (for example, the information relating to the jig 50 (50*a*), printing image information, printing position information, etc., expressed by numbers and symbols) is automatically transmitted to the controller 22. The controller 22 creates printing control information in which control details of various components are stipulated based on the information obtained from the barcode 61. Printing can be performed as desired on the medium 8 (medium 9) by exerting control over various components based on the printing control information.

In the first and second embodiments, a case is explained in which the UV curable ink is used. However, the present invention can be applied to a printer that uses inks other than the UV curable ink, for example, a water-based ink, an oil-based ink, and a solvent ink.

In the first and second embodiments, a structure is explained as an example in which the controller 22 calculates the position information of each of the containing recesses 55 (the medium 8) relative to the vacuum table 13 based on the detection results obtained from the registration mark detection unit 34 and the barcode detection unit 35, and creates the control information relating to the control for discharging the UV ink and the control for irradiation with the ultraviolet light. However, the present invention is not limited to this structure. For example, the controller 22 can be connected to a not shown host computer via an interface to transmit the detection results to the host computer. The position information can be calculated and the control information can be created on the host computer and the same information can be transmitted from the host computer to the controller 22. In this case, the controller 22 exerts control based on the information transmitted from the host computer, and performs printing on the medium 8.

In the first and second embodiments, the control information relating to the control for discharging the UV ink and the control for irradiation with the ultraviolet light set by the controller 22 can be applied only for an area enclosed by the first registration mark 62*a* to the fourth registration mark 62*d*. Alternatively, the control information can be applied across the entire vacuum table 13 irrespective of the size of the jig 50.

In the first and second embodiments, a structure is explained in which the first registration mark 62*a* to the fourth registration mark 62*d* are detected, and any of the first registration mark 62*a* to the fourth registration mark 62*d* is set as the reference mark. Alternatively, the position of the medium relative to the vacuum table 13 can be detected by assuming a mechanical origin of the printer as the reference mark. In this case, the control information relating to the control for discharging the UV ink printed on the entire surface of the vacuum table 13 and the control for irradiation with the ultraviolet light is created by the host computer and the printer 1 performs printing based on the mechanical origin. In this structure, inclination information of the jig 50 relative to the vacuum table 13 that is obtained by detecting the first registration mark 62*a* to the fourth registration mark 62*d* is used for obtaining a rotation angle when a correction is to be made by rotating image data of the medium and for obtaining the position of the medium.

In the first and second embodiments, a structure is explained as an example in which the registration mark detection unit 34 and the barcode detection unit 35 are configured as separate devices. However, the present invention is not limited to this structure. For example, a single detection unit, for example, a barcode detection unit that can also detect a registration mark or a registration mark detection unit that can also detect a barcode, can be used.

In the second embodiment, a structure is explained in which information (holding platform information in the claims) about the corresponding jig is included in each of the jigs 50 and 50*a*. Therefore, this structure is especially effective when printing is to be performed in one sitting using jigs of different types. Furthermore, the above structure is also effective when performing lot management, tracking study, etc., of the medium on which the printing is performed. Furthermore, a single jig that can hold the mediums of different types (shapes) can be used.

Third Embodiment

In the first and second embodiments, a structure is explained as an example in which the barcode 61 and the first registration mark 62*a* to the fourth registration mark 62*d* are formed on the jig 50. In the third embodiment, the first registration mark 62*a* to the fourth registration mark 62*d* are formed but the barcode 61 is not formed on the jig 50. The third embodiment is explained with reference to FIGS. 8 and 9. The same reference numerals are assigned to the components that are identical to that of the first embodiment and explanation thereof is omitted. Components having a structure different from that of the first embodiment are explained below.

Figure 8:
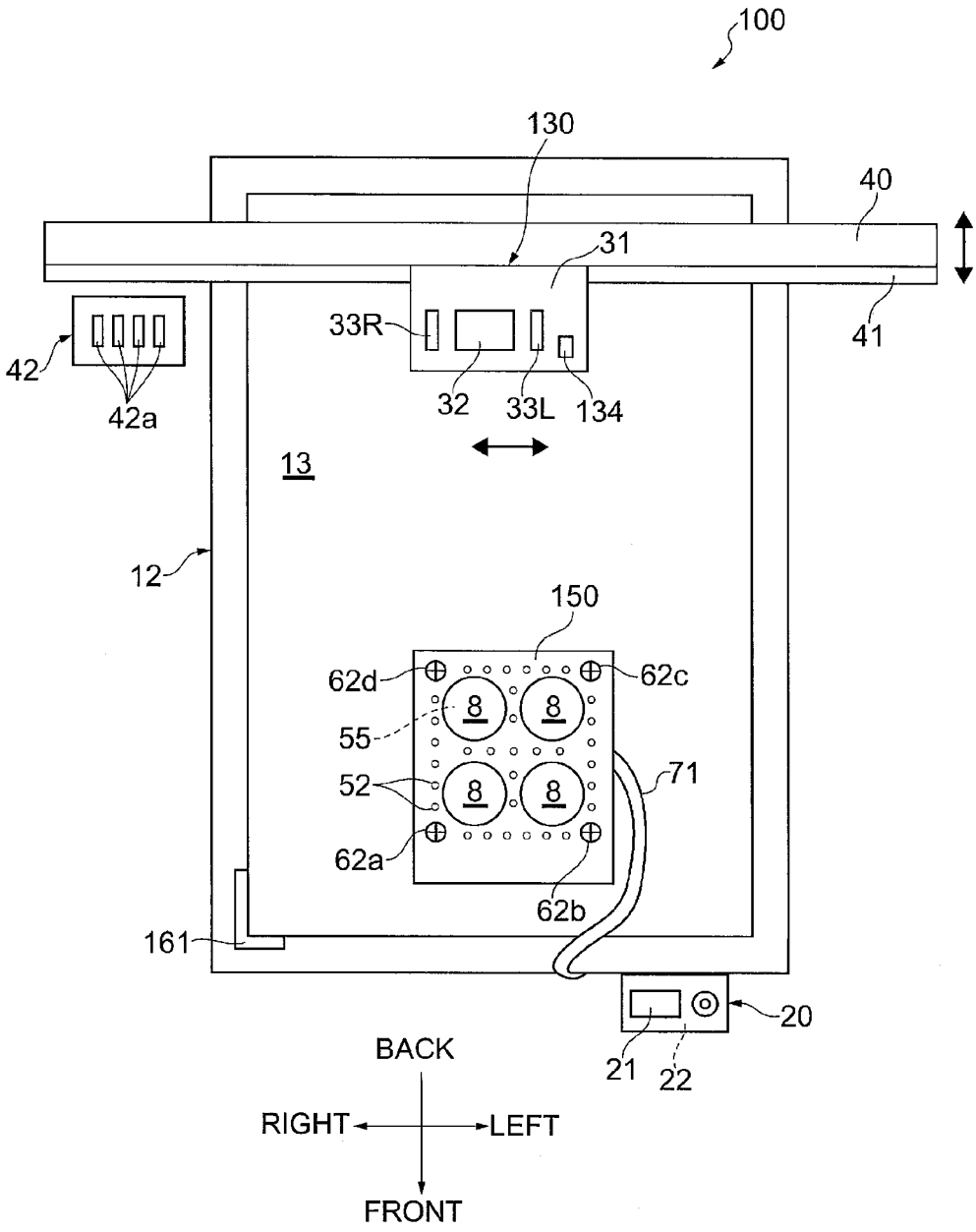
FIG. 8 is a plan view of a printer according to a third embodiment of the present invention.

As shown in FIG. 8, in a printer 100 according to the third embodiment, a printing unit 130 includes a registration mark detection unit 134 mounted thereon and does not include a barcode detection unit. The first registration mark 62*a* to the fourth registration mark 62*d* are formed on a jig 150; however, a barcode that specifies the information relating to the jig 150 is not formed. As shown in FIG. 8, because there is no need to discriminate the type of the jig when only one type of the jig (only the jig 150) can be mounted on the vacuum table 13, there is no need to form the barcode on the jig 150. A light sensor can be used as the registration mark detection unit 134 to detect the positions of the first registration mark 62*a* to the fourth registration mark 62*d* based on variations in the light receiving intensity of the inspection light. Furthermore, other than the light sensor, a CCD (charge-coupled device) camera can be used. The CCD camera captures an image of the vacuum table 13 from above and detects the positions of the first registration mark 62*a* to the fourth registration mark 62*d* on the vacuum table 13 by extracting the first registration mark 62*a* to the fourth registration mark 62*d* included in the image data obtained after the image is captured.

In the printer 100 configured as described above, printing is performed in a printing sequence described below. First, the medium 8 is set on the jig 150 and the jig 150 is mounted on the vacuum table 13 at an arbitrary position. The registration mark detection unit 134 detects the center positions of the first registration mark 62*a* to the fourth registration mark 62*d* while the printing unit 130 is being moved in the front-back and/or left-right directions. Any of the detected center positions of the first registration mark 62*a* to the fourth registration mark 62*d* is set as the reference mark. Subsequently, the registration mark detection unit 134 detects a skew (inclination) of the jig 150 relative to the vacuum table 13 based on the center positions of the first registration mark 62*a* to the fourth registration mark 62*d* and corrects the inclination of the image data of the medium 8 based on the detected inclination. The inclination of the image data can be corrected by the controller 22 or by the host computer connected to the controller 22 via the interface. Once the printing unit 130 is moved to a home position, the first registration mark 62*a* to the fourth registration mark 62*d* are detected again and printing is performed on the medium 8.

As described in the printing sequence above, the first registration mark 62*a* to the fourth registration mark 62*d* are detected by scanning the entire surface of the vacuum table 13 and printing is performed by setting one of the first registration mark 62*a* to the fourth registration mark 62*d* as the reference mark. Alternatively, an aligning member 161 that is used for aligning the jig 150 with the origin (the mechanical origin) of the printer 100 when the jig 150 is mounted can be arranged beforehand on the vacuum table 13. When the aligning member 161 is used to align the jig 150 while mounting, because a detectable range of the first registration mark 62*a* to the fourth registration mark 62*d* is already known, the entire surface of the vacuum table 13 need not be scanned. When the aligning member 161 is used, the inclination of the image data can be corrected based on the inclination of the jig 150 obtained by detection of the first registration mark 62*a* to the fourth registration mark 62*d*.

Figure 9:
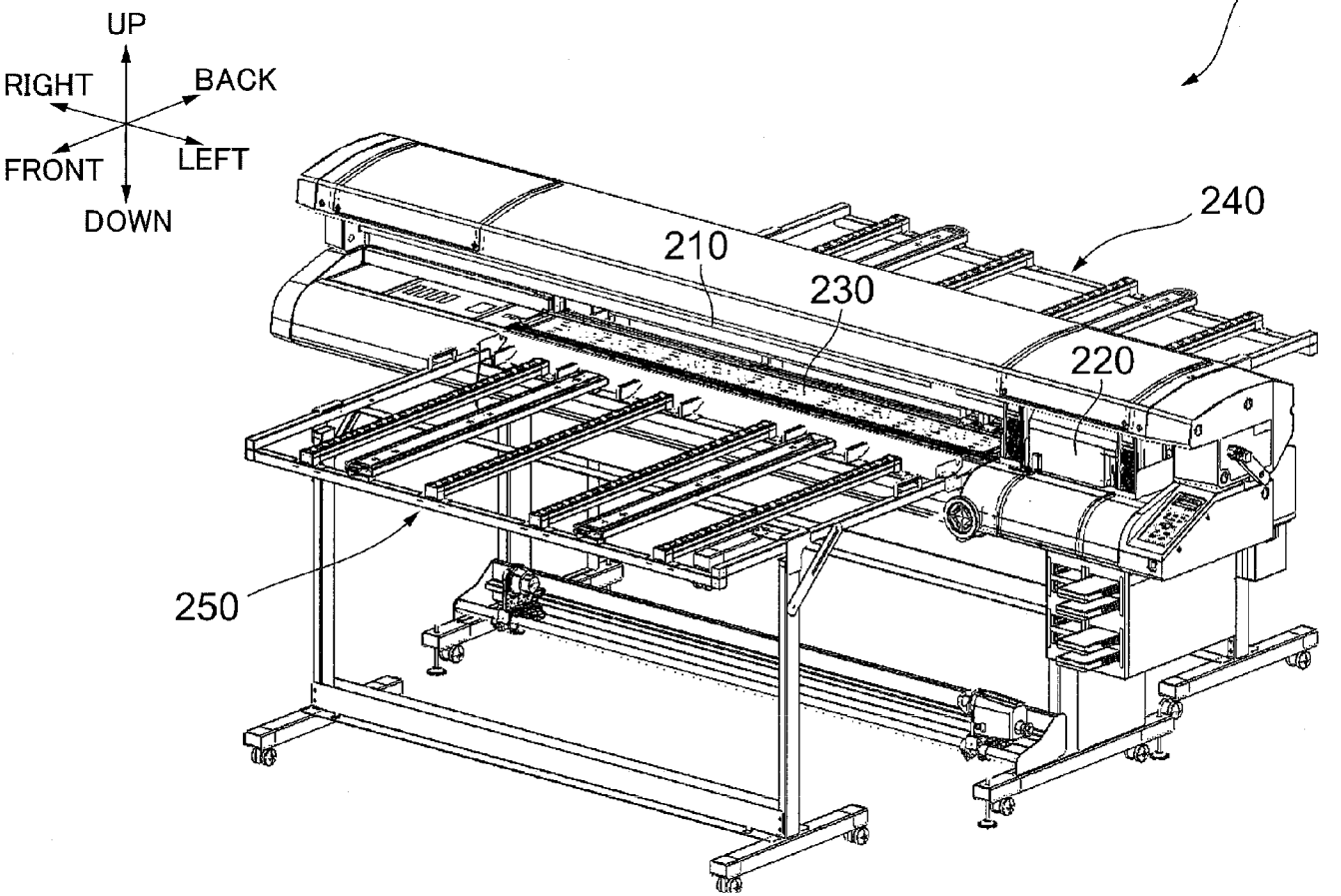
FIG. 9 is a perspective view of a grid printer.

So far, a structure is explained as an example in which printing is performed by mounting the jig 150 on a so-called flatbed printer 100. However, printing can be performed by mounting the jig 150 on a so-called grid printer 200 that performs printing while moving a medium in the front-back direction as shown in FIG. 9.

In the printer 200, a printing unit 220 with a not shown printer head and a not shown registration mark detection unit mounted thereon is attached to a guide rail 210 so as to be movable in the left-right direction. A flat plate-like platen 230 is exposed and arranged so as to vertically face the printing unit 220. Furthermore, a not shown clamp mechanism that holds therebetween a medium and a not shown transport mechanism that moves the medium in the front-back direction are arranged. In the printer 200 having such a structure, the jig 150, if mountable, is mounted on the platen 230, and printing is performed after the first registration mark 62*a* to the fourth registration mark 62*d* are detected.

In the case in which the jig 150 cannot be mounted on the platen 230 due to its size, printing is performed by arranging support platforms 240 and 250 on the front and back to substantially horizontally hold the jig 150. A printing sequence in such a case is explained next. The medium 8 is first set on the jig 150 and then the jig 150 is mounted on the platen 230. Thereafter, the jig 150 is clamped with the clamp mechanism, and set by the transport mechanism such that it can be moved in the front-back direction relative to the platen 230. Subsequently, the printing unit 220 is moved in the left-right direction while moving the jig 150 in the front-back direction. The registration mark detection unit detects the center positions of the first registration mark 62*a* to the fourth registration mark 62*d* and sets any of the detected center positions of the first registration mark 62*a* to the fourth registration mark 62*d* as the reference mark. The inclination of the jig 150 in the front-back direction is detected based on the position of the first registration mark 62*a* to the fourth registration mark 62*d* and inclination of the image data is corrected based on the detected inclination.

The inclination of the image data can be corrected by the printer 200 or by the host computer that is connected to the printer 200 via the interface. After the jig 150 is moved in the front or back direction to the reference mark position, the first registration mark 62*a* to the fourth registration mark 62*d* are detected again and printing is performed on the medium 8. After printing on the medium 8 is completed, the clamping mechanism releases its hold on the jig 150 and the jig 150 is removed from the printer 200.

One of the advantages that is achieved by the structure explained in the third embodiment is that, if the jig mounted on the vacuum table 13 is already known (when only one type of the jig is used), a jig having a simple structure without having a barcode thereon can be used for holding the medium on which printing is to be performed.

Fourth Embodiment

In the first and second embodiments, a structure is explained as an example in which the barcode 61 and the first registration mark 62*a* to the fourth registration mark 62*d* are formed on the jig 50. In a fourth embodiment, a structure is explained in which a jig 351 is used on which a barcode 352 is formed but no registration marks are formed. The fourth embodiment is explained below with reference to FIG. 10. In the explanation given below, the same reference numerals are assigned to the components that are identical to that of the first embodiment and explanation thereof is omitted. Components having a structure different from that of the first embodiment are explained below.

Figure 10:
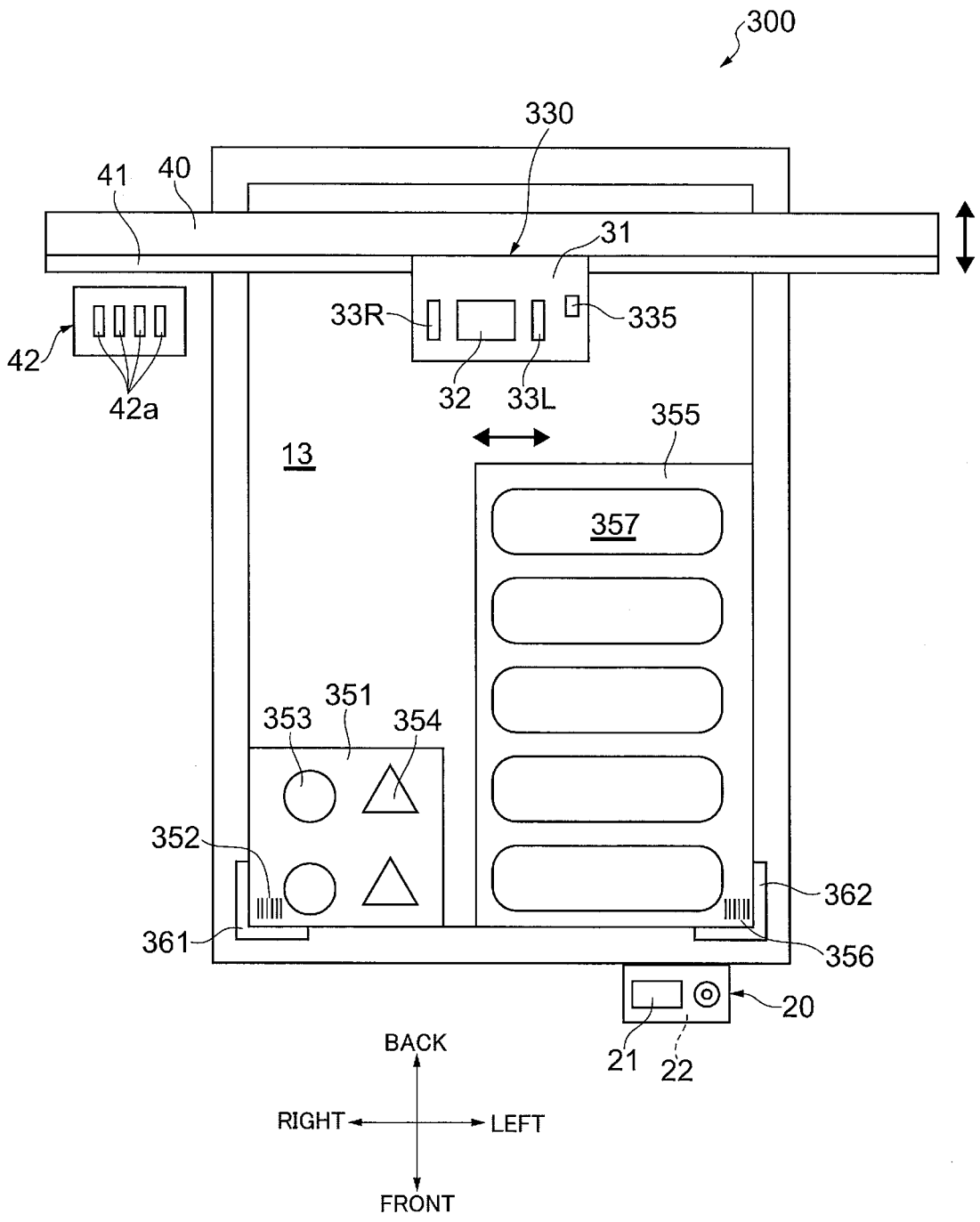
FIG. 10 is a plan view of a printer according to a fourth embodiment of the present invention.

As shown in FIG. 10, a printer 300 according to the fourth embodiment includes a printing unit 330 on which a barcode detection unit 335 is mounted instead of a registration mark detection unit. The barcode 352 that contains information specifying the jig 351 is formed on the jig 351 but no registration marks are formed. An aligning member 361 is arranged on a right front edge of the vacuum table 13 to align the jig 351 with a mechanical origin of the printer 300 when the jig 351 is mounted.

In FIG. 10, a structure is explained as an example in which the barcode detection unit 335 is mounted on the single carriage 31. Alternatively, a structure in which the barcode detection unit 335 is not mounted on the single carriage 31 can also be used. For example, if it is already known that the barcode 352 will move to a predetermined position when the jig 351 is aligned by the aligning member 361, the barcode detection unit 335 can be separated from the single carriage 31 and fixed near the predetermined position. In this case, to accurately read the information encoded in the barcode 352, the barcode detection unit 335 and the barcode 352 need to be moved relatively by at least a horizontal length of the barcode 352. The operator can manually hold the barcode detection unit 335 over the barcode 352, as required, and read the information encoded in the barcode 352. Such a hand-held barcode detection unit 335 can be connected to the controller 22 of the printer 300 by, for example, a universal serial bus (USB) connection. Furthermore, the hand-held barcode detection unit 335 can be connected to the host computer connected to the printer 300 via the interface by the USB connection.

Instead of storing the information relating to the jig 351 (for example, the information relating to positions of mediums 353 and 354 on the jig 351) in the barcode 352, jig identification information (the holding platform information in the claims) that specifies a type of the jig 351 can be stored in the barcode 352, and an analysis table in which layouts, dimensions, shapes, etc., of the mediums 353 and 354 are linked to the jig identification information can be included in the host computer. With this structure, the position information, etc., (for example, a printing range and origin positions) of the mediums 353 and 354 held by the jig 351 can be obtained on the host computer by comparative reference of the jig identification information stored in the barcode 352 and the analysis table. While performing printing on the mediums 353 and 354, the mechanical origin of the printer 300 can be used as the reference mark or an origin obtained by combining the mounting position of the jig 351 and the origin position set within the jig 351 can be used.

A printing pattern in which a background is colored can be used. For example, solid printing can be performed on the entire printing area of the mediums 353 and 354, and characters, patterns, etc., can be printed over the portion where solid printing has been performed. Because number of image data pieces to be copied when generating the image data by an RIP (Raster Image Processor) by comparative reference of the analysis table in the host computer is already known, data processing load is reduced. Coordinates of the mediums 353 and 354 can be identified by the controller 22 instead of by the host computer.

An example of a sequence for performing printing on the mediums 353 and 354 held by the jig 351 is explained below. First, the mediums 353 and 354 are set on the jig 351. The jig 351 is then aligned by the aligning member 361 when the jig 351 is mounted on the vacuum table 13. The barcode detection unit 335 is brought to a position facing the barcode 352 by moving the printing unit 330 in the front-back and/or left-right directions so that the barcode detection unit 335 reads the jig identification information relating to the jig 351 stored in the barcode 352. Thereafter, the host computer that has received the jig identification information creates the image data referring to the analysis table linked to the jig identification information, and transmits the created image data to the printer 300 (the controller 22). Once the printing unit 330 is returned to the home position, the printer 300 performs printing on the mediums 353 and 354 based on the image data received from the host computer.

In the printer 300, the jig identification information stored in each barcode can be read using the barcode detection unit 335. Therefore, as shown in FIG. 10, when a plurality of types of the jig 351 and a jig 355 is mounted on the vacuum table 13 and the barcode 352 formed on the jig 351 and a barcode 356 formed on the jig 355 are read, printing can be performed at the same time on the mediums 353 and 354 and a medium 357. The jig 355 is moved to the predetermined position by an aligning member 362 when it is mounted on the vacuum table 13.

The jig 351 according to the fourth embodiment can be mounted on the grid printer 200 shown in FIG. 9 and printing can be performed. In this case, it is necessary to arrange not shown transport assisting members one each on the left end and the right end of the jig 351 to guide the jig 351 to move straight front and back. The reference position in this case is set in a similar manner as when printing is performed on a general standard sheet. In FIG. 10, a structure is explained as an example in which the aligning member 361 is arranged to align the jig 351 with the vacuum table 13 when the jig 351 is mounted. However, the present invention is not limited to this structure. That is, as long as the jig 351 can be aligned with the vacuum table 13 by any method when the jig 351 is mounted, there is no need to form the registration marks on the jig 351.

One of the advantages that are achieved by the structure described in the fourth embodiment above is that, when performing printing by mounting a plurality of types of the jigs holding mediums of different shapes on the vacuum table 13, a jig having a simple structure without the registration marks formed thereon can be used for holding the medium on which printing is to be performed.

In the first to third embodiments, the jig identification information can be formed on the jig in a format (for example, a symbol format) that can be detected by the registration mark detection unit, and the analysis table linked to the jig identification information (the layout, dimension, shape, etc., of the medium on the jig) can be stored in the host computer. In this structure, because the registration mark detection unit can detect the layout, size, shape, etc., of the medium (hereinafter, referred to as medium information) on the jig by reading the symbols formed on the jig, there is no need to include the medium information in the barcode.

In the third embodiment, when the CCD camera is used as the registration mark detection unit 134, it is necessary to perform image processing in which an outline portion of the registration marks is extracted from the image data obtained by capturing the image. Because the medium information is detected in conjunction with the image processing, there is no need to form the barcode. The inclination of the jig can be detected by extracting an outline of the rectangular jig from the obtained image data. Symbols that are linked to the jig identification information are formed on the jig. Therefore, by capturing the symbols by the CCD camera and performing character recognition, the medium information can be detected even without using the barcode.

In the first, second, and fourth embodiments, the RFID tag can be used instead of the barcode. Particularly, when a readable/writable RFID tag is used, the medium information that is rewritably stored using an RFID writer can be exchanged between the RFID writer and an RFID reader via wireless communication. A passive RFID tag can be used to give directional characteristics to the transmission information. By this, for example, when a plurality of the jigs is mounted on the vacuum table 13, the jig with which RFID tag communication is established can be accurately identified.

In the first, second and fourth embodiments, an integrated circuit (IC) chip that rewritably stores therein the medium information can be used instead of the barcode. In this structure, an interface connecting to an IC chip reader, which reads the information stored in the IC chip, can be wired or wireless.

In the first, second, and fourth embodiments, a magnetic stripe that rewritably stores therein the medium information can be used instead of the barcode. In this case, a magnetic head can be used as a reading device to read the information stored in the magnetic stripe.

In the first, second, and fourth embodiments, a thermosensitive sheet on which the medium information is rewritably printed can be used instead of the barcode. It is possible to identify the medium information by capturing the characters, symbols, etc., printed on the thermosensitive sheet by the CCD camera and performing character recognition and by making comparative reference of the recognized characters, symbols, etc., and the analysis table. The characters or the symbols can be directly formed on the jig. For example, the characters or the symbols can be engraved or printed on the jig using the printer.

Storage units, such as, the RFID tag, IC chip, magnetic stripe, and thermosensitive sheet that can rewritably store therein the medium information are especially effective when items, from among the medium information, that need to be changed according the medium (the shape, dimension, etc., of the medium) are to be rewritten. In this structure, the information to be rewritten is not dependent on the type of the jig.

In the first and second embodiments, a case is explained as an example in which the dimensions of the printing area of the medium depend on the dimensions of a recess portion of the jig. However, the relation between the shape of the jig and the printing area is not to be thus limited. That is, the shape or the dimensions of the printing area of the medium can be independent of the shape and the dimensions of the medium and the shape of the recess portion of the jig.

In the first and second embodiments, a case is explained as an example in which the medium is held against the jig by fitting it in the recess portion of the jig. Alternatively, a jutting portion can be formed on the jig, and the medium can be held by being fitted on the jutting portion. Furthermore, a brace that can hold the medium partially or entirely can be arranged on the jig, and the medium can be held with the brace. Moreover, to ensure that the medium is held firmly against the jig, the recess or the jutting portion can be formed to conform to the underside contour of the medium so that the underside of the medium is in tight contact with the jig.

In the jig 50 according to the first embodiment explained above, by having the suction hole communicating with the hollow portion 53 and the containing recess 55, the medium 8 can be suction fitted firmly in the containing recess 55 by the negative pressure produced by the supply/drain blower 14.

In the third embodiment explained above, the aligning member 161 arranged on the vacuum table 13 aligns the jig 150 mounted on the vacuum table 13 to the right front edge of the vacuum table 13. However, structures other than this are also possible. For example, pins can be arranged in the form of a frame on the vacuum table 13, and the jig can be mounted by fitting it within the area defined by the pins.

In the first to fourth embodiments explained above, it is preferable that the right ultraviolet radiation device 33R and the left ultraviolet radiation device 33L that can irradiate the ultraviolet light be arranged. For example, when printing is to be performed on a polyester or a polycarbonate medium, which does not allow the UV ink discharged from the printer head to penetrate, the ink adhering to the medium can be reliably cured by irradiating it with the ultraviolet light from the ultraviolet radiation devices. Therefore, printing can be performed on a medium that does not allow the ink to penetrate by causing the UV ink to adhere thereto.

Furthermore, in the first embodiment explained above, it is preferable that the printer head 32, the right ultraviolet radiation device 33R and the left ultraviolet radiation device 33L, the registration mark detection unit 34, and the barcode detection unit 35 be mounted on the single carriage 31. With this structure, for example, compared with a structure in which the constituent parts are mounted on two or more carriages, the number of components can be reduced, and the control system can be made simple.

Furthermore, in the second embodiment explained above, it is preferable that the printer head 32, and the right ultraviolet radiation device 33R and the left ultraviolet radiation device 33L be mounted on the work carriage 31*a*, and the registration mark detection unit 34 and the barcode detection unit 35 be mounted on the detection carriage 31*b*. With this structure, when printing on the medium by operating the printer head 32 and the right ultraviolet radiation device 33R and the left ultraviolet radiation device 33L, the detection carriage 31*b* can be moved out of the way to the left or the right end of the guide rail. Consequently, the ink that is discharged from the printer head 32 and suspended in the air during printing can be prevented from adhering to the registration mark detection unit 34 and the barcode detection unit 35. As a result, incidence of faulty detection by the registration mark detection unit 34 and the barcode detection unit 35 can be reduced.

In the first to third embodiments explained above, a structure having four registration marks (the first registration mark 62*a*, the second registration mark 62*b*, the third registration mark 62*c*, and the fourth registration mark 62*d*) has been described. However, the present invention is not limited to this structure. In a structure similar to the structure in the first to third embodiments where the barcode is formed on the jig and the jig is mounted in the front-back direction on the vacuum table 13, only a single registration mark that functions as the reference mark need be formed.

In the first to fourth embodiments explained above, when the jig is mounted at any arbitrary position on the vacuum table 13 and the barcode or the registration mark is detected, instead of scanning the entire vacuum table 13, the operator can move the carriage manually close to the barcode or the registration mark, and thereafter let the scanning and the detection of the barcode or the registration mark be performed.

In the first to fourth embodiments explained above, the structure in which the jig is mounted on the vacuum table 13 or the platen 230 is described as an example. However, the present invention is not to be thus limited. For example, the vacuum table 13 can be formed as a mere skeletal frame, and the jig can be replaceably supported by the skeletal frame to hold the medium. Furthermore, a jig that does not have a hollow portion within can be used instead of the jig having the hollow portion within.

Furthermore, in the first to fourth embodiments explained above, if the aligning member is used in the case where only one type of the jig is to be used (when the position of the medium on the jig is already known), a mounting detection switch can be arranged in the aligning member to detect that the jig has been set. With this structure, the position information can be acquired just by reading the position of the medium on the jig, based on detection signals output from the mounting detection switch, without having to read the barcode formed on the jig.

In the first to fourth embodiments explained above, when forming and detecting the positions of the registration marks in the case where only one type of the jig is used (when the position of the medium on the jig is already known), the position of the jig on the vacuum table and the position of the medium on the jig can be detected by detecting the positions of the registration marks. That is, the position of the medium on the vacuum table can be detected by detecting the positions of the registration marks, and hence, the barcode formed on the jig need not be read.

In the first to fourth embodiments explained above, when the aligning member is used in the case where a plurality of types of the jigs is used, the position of the medium on the vacuum table can be detected by reading the barcode formed on each jig. Instead of having the barcode detection unit read the barcode, a structure can be adopted where, for example, holding platform information that identifies the type of the jig can be printed as a character string at a noticeable spot on each jig, and the operator can recognize and manually enter the character string into the printer.

Furthermore, in the first to fourth embodiments explained above, when forming and detecting the positions of the registration marks in the case where a plurality of types of the jigs is used, the position of the jig on the vacuum table can be detected by detecting the positions of the registration marks. Furthermore, the position of the medium on the vacuum table can be detected by reading the barcode formed on each jig. The position of the medium on the vacuum table can be detected based on the above two detected pieces of position information. Instead of having the barcode detection unit read the barcode, a structure can be adopted where, for example, the holding platform information that identifies the type of the jig can be printed as a character string at a noticeable spot on each jig, and the operator can recognize and manually enter the character string into the printer.

Various structural patterns have been explained above in the first to fourth embodiments. However, mainly two pieces of position information are required for printing on the medium held against the jig which in turn is held against the vacuum table 13 by suction, namely, the position information of the jig on the vacuum table 13 (the support position information in the claims) and the position information of the medium on the jig. The position information of the medium on the vacuum table 13 can be detected based on these two pieces of position information.

In the first to fourth embodiments explained above, a USB, an RS-232C (Recommended standard-232c), a wired and/or wireless LAN, an infrared communication or a Bluetooth (Registered Trademark), etc., can be used as an interface that connects the controller 22 and the host computer. Any of the devices mentioned above can also be used as an interface that connects the controller 22 (host computer) and each reader.

The invention claimed is:

1. A droplet discharge device comprising:

a base member that supports a holding platform that holds a medium at a predetermined medium holding position;

a droplet discharge unit that discharges droplets;

a relative movement unit that moves the droplet discharge unit relative to the medium, while the medium is held against the holding platform that is supported by the base member;

a holding-platform information acquiring unit that acquires holding platform information for identifying the holding platform and support position information relating to a support position of the holding platform mounted on the base member; and a discharge control unit that controls movement of the droplet discharge unit by the relative movement unit and discharge of the droplets from the droplet discharge unit, based on information relating to the holding platform identified in the holding platform information acquired from the holding-platform information acquiring unit, the support position information acquired by the holding-platform information acquiring unit, and information relating to an intended pattern, to cause the droplets to adhere to a surface of the medium held at the predetermined medium holding position to form the intended pattern.

2. The droplet discharge device according to claim 1, further comprising an information reading unit that reads the holding platform information of the holding platform.

3. The droplet discharge device according to claim 2, wherein the holding platform information includes at least one piece of information among information that identifies a type of the holding platform, position information that indicates a holding position of the medium on the holding platform, layout information of the medium, quantity information, dimension information, and shape information.

4. The droplet discharge device according to claim 2, wherein the holding platform is box-shaped with a hollow portion inside, the hollow portion is connected to a suction unit that can produce a negative pressure in the hollow portion, a suction hole that communicates with the hollow portion is formed in a portion of the holding platform that is just off the medium holding position, and an airflow that flows toward the hollow portion is produced in the suction hole by the suction unit.

5. The droplet discharge device according to claim 1, further comprising an alignment holding unit that aligns and holds the holding platform at a predetermined support position on the base member, wherein the support position information is acquired based on the position of the holding platform that has been positioned and held by the alignment holding unit.

6. The droplet discharge device according to claim 5, wherein the holding platform is box-shaped with a hollow portion inside, the hollow portion is connected to a suction unit that can produce a negative pressure in the hollow portion, a suction hole that communicates with the hollow portion is formed in a portion of the holding platform that is just off the medium holding position, and an airflow that flows toward the hollow portion is produced in the suction hole by the suction unit.

7. The droplet discharge device according to claim 1, further comprising reference marks on the holding platform that are used for acquiring the support position information, wherein the holding-platform information acquiring unit detects the reference marks to acquire the support position information.

8. The droplet discharge device according to claim 1, wherein the holding platform information includes at least one piece of information among information that identifies a type of the holding platform, position information that indicates a holding position of the medium on the holding platform, layout information of the medium, quantity information, dimension information, and shape information.

9. The droplet discharge device according to claim 1, wherein the holding platform is box-shaped with a hollow portion inside, the hollow portion is connected to a suction unit that can produce a negative pressure in the hollow portion, a suction hole that communicates with the hollow portion is formed in a portion of the holding platform that is just off the medium holding position, and an airflow that flows toward the hollow portion is produced in the suction hole by the suction unit.

10. A droplet discharge device comprising:

a base member that supports a holding platform that holds a medium at a predetermined medium holding position;

a droplet discharge unit that discharges droplets;

a relative movement unit that moves the droplet discharge unit relative to the medium, while the medium is held against the holding platform that is supported by the base member;

a holding-platform information acquiring unit that acquires holding platform information for identifying the holding platform; and a discharge control unit that controls movement of the droplet discharge unit by the relative movement unit and discharge of the droplets from the droplet discharge unit, based on information relating to the holding platform identified in the holding platform information acquired from the holding-platform information acquiring unit and information relating to an intended pattern, to cause the droplets to adhere to a surface of the medium held at the predetermined medium holding position to form the intended pattern.

11. The droplet discharge device according to claim 10, further comprising an information reading unit that reads the holding platform information of the holding platform.

12. The droplet discharge device according to claim 10, wherein the holding platform information includes at least one piece of information among information that identifies a type of the holding platform, position information that indicates a holding position of the medium on the holding platform, layout information of the medium, quantity information, dimension information, and shape information.

13. The droplet discharge device according to claim 10, wherein the holding platform is box-shaped with a hollow portion inside, the hollow portion is connected to a suction unit that can produce a negative pressure in the hollow portion, a suction hole that communicates with the hollow portion is formed in a portion of the holding platform that is just off the medium holding position, and an airflow that flows toward the hollow portion is produced in the suction hole by the suction unit.

14. A droplet discharge device comprising:

a base member that supports a holding platform that holds a medium at a predetermined medium holding position;

a droplet discharge unit that discharges droplets;

a relative movement unit that moves the droplet discharge unit relative to the medium, while the medium is held against the holding platform that is supported by the base member;

a holding-platform information acquiring unit that acquires support position information relating to a support position of the holding platform mounted on the base member; and a discharge control unit that controls movement of the droplet discharge unit by the relative movement unit and discharge of the droplets from the droplet discharge unit, based on the support position information acquired by the holding-platform information acquiring unit and information relating to an intended pattern, to cause the droplets to adhere to a surface of the medium held at the predetermined medium holding position to form the intended pattern.

15. The droplet discharge device according to claim 14, further comprising an alignment holding unit that aligns and holds the holding platform at a predetermined support position on the base member, wherein the support position information is acquired based on the position of the holding platform that has been positioned and held by the alignment holding unit.

16. The droplet discharge device according to claim 14, further comprising reference marks on the holding platform that are used for acquiring the support position information, wherein the holding-platform information acquiring unit detects the reference marks to acquire the support position information.

17. The droplet discharge device according to claim 14, wherein the holding platform is box-shaped with a hollow portion inside, the hollow portion is connected to a suction unit that can produce a negative pressure in the hollow portion, a suction hole that communicates with the hollow portion is formed in a portion of the holding platform that is just off the medium holding position, and an airflow that flows toward the hollow portion is produced in the suction hole by the suction unit.

18. A droplet discharge method executed on a droplet discharge device, the droplet discharge device including a base member that supports a holding platform that holds a medium at a predetermined medium holding position, a droplet discharge unit that discharges droplets, and a relative movement unit that moves the droplet discharge unit relative to the medium, while the medium is held against the holding platform that is supported by the base member, the droplet discharge method comprising:

acquiring holding platform information that identifies the holding platform and support position information relating to a support position of the holding platform mounted on the base member; and controlling movement of the droplet discharge unit by the relative movement unit and discharge of the droplets from the droplet discharge unit, based on information relating to the holding platform identified in the holding platform information acquired at the acquiring, the support position information acquired at the acquiring, and information relating to an intended pattern, and causing the droplets to adhere to a surface of the medium held at the predetermined medium holding position to form the intended pattern.

19. A droplet discharge method executed on a droplet discharge device, the droplet discharge device including a base member that supports a holding platform that holds a medium at a predetermined medium holding position, a droplet discharge unit that discharges droplets, and a relative movement unit that moves the droplet discharge unit relative to the medium, while the medium is held against the holding platform that is supported by the base member, the droplet discharge method comprising:

acquiring holding platform information that identifies the holding platform; and controlling movement of the droplet discharge unit by the relative movement unit and discharge of the droplets from the droplet discharge unit, based on information relating to the holding platform identified in the holding platform information acquired at the acquiring and information relating to an intended pattern, and causing the droplets to adhere to a surface of the medium held at the predetermined medium holding position to form the intended pattern.

20. A droplet discharge method executed on a droplet discharge device, the droplet discharge device including a base member that supports a holding platform that holds a medium at a predetermined medium holding position, a droplet discharge unit that discharges droplets, and a relative movement unit that moves the droplet discharge unit relative to the medium, while the medium is held against the holding platform that is supported by the base member, the droplet discharge method comprising:

acquiring support position information relating to a support position of the holding platform mounted on the base member; and controlling movement of the droplet discharge unit by the relative movement unit and discharge of the droplets from the droplet discharge unit, based on the support position information acquired at the acquiring and information relating to an intended pattern, and causing the droplets to adhere to a surface of the medium held at the predetermined medium holding position to form the intended pattern.

* * * * *